US006749027B1

(12) United States Patent
Crabtree et al.

(10) Patent No.: US 6,749,027 B1
(45) Date of Patent: Jun. 15, 2004

(54) FIRE FIGHTING NOZZLE AND METHOD INCLUDING PRESSURE REGULATION, CHEMICAL AND EDUCATION FEATURES

(76) Inventors: Dennis W. Crabtree, 4850 Dellwood, Beaumont, TX (US) 77707; Dwight P. Williams, 1530 Texla Rd., Vidor, TX (US) 77662

( * ) Notice: Subject to any disclaimer, the term of this patent is extended or adjusted under 35 U.S.C. 154(b) by 0 days.

(21) Appl. No.: 09/284,561

(22) PCT Filed: Sep. 25, 1998

(86) PCT No.: PCT/US98/20061

§ 371 (c)(1),
(2), (4) Date: Apr. 15, 1999

(87) PCT Pub. No.: WO99/51306

PCT Pub. Date: Oct. 14, 1999

Related U.S. Application Data

(60) Provisional application No. 60/080,846, filed on Apr. 6, 1998.

(51) Int. Cl.[7] ..... A62C 2/00

(52) U.S. Cl. ..... 169/44; 169/14; 239/408; 239/413; 239/416.4; 239/417.5; 239/453; 239/424; 239/514; 239/579; 239/416

(58) Field of Search ..... 239/407, 408, 239/413, 416.4, 416, 416.5, 417.3, 417.5, 419, 424, 505, 514, 518, 524, 541, 570, 579, 459, 455, 451, 452, 553.1, 533.15, 546, 583; 169/44, 46, 47, 14; 137/629

(56) References Cited

U.S. PATENT DOCUMENTS

| | | | | | |
|---|---|---|---|---|---|
| 434,633 | A | | 8/1890 | Fayod | |
| 2,207,758 | A | * | 7/1940 | Rehse | 239/417 |
| 3,069,846 | A | * | 12/1962 | Buescher | 137/625.34 |
| 3,342,419 | A | | 9/1967 | Weese | |
| 3,554,452 | A | * | 1/1971 | Davidson et al. | 169/24 |
| 3,684,192 | A | | 8/1972 | McMillan | |
| 3,863,844 | A | | 2/1975 | McMillan | |
| 3,893,624 | A | | 7/1975 | Thompson | |
| 3,904,125 | A | | 9/1975 | Allenbaugh | |
| RE29,717 | E | | 8/1978 | Thompson | |
| 4,289,277 | A | | 9/1981 | Allenbaugh | |
| 4,470,549 | A | | 9/1984 | McMillan et al. | |
| 4,589,439 | A | | 5/1986 | Steingass | |
| 4,623,095 | A | | 11/1986 | Pronk | |
| 4,640,461 | A | | 2/1987 | Williams | |
| 4,653,693 | A | | 3/1987 | Steingass | |
| 4,730,774 | A | | 3/1988 | Shippe | |
| 4,944,460 | A | | 7/1990 | Steingass | |
| 5,167,285 | A | | 12/1992 | Williams et al. | |
| 5,275,243 | A | | 1/1994 | Williams et al. | |
| 5,312,041 | A | | 5/1994 | Williams et al. | |
| 5,312,048 | A | | 5/1994 | Steingass et al. | |
| 5,562,248 | A | | 10/1996 | Khalifka | |
| 5,575,341 | A | | 11/1996 | Baker et al. | |
| 5,593,092 | A | | 1/1997 | McMillan et al. | |
| 5,613,773 | A | | 3/1997 | Scott et al. | |
| 5,678,766 | A | | 10/1997 | Peck et al. | |
| 5,779,158 | A | | 7/1998 | Baker | |
| 5,779,159 | A | | 7/1998 | Williams et al. | |
| 5,992,529 | A | * | 11/1999 | Williams | 169/14 |
| 6,102,308 | A | * | 8/2000 | Steingass et al. | 169/27 |

FOREIGN PATENT DOCUMENTS

| | | |
|---|---|---|
| WO | WO 94/14499 | 7/1994 |
| WO | WO 97/38757 | 10/1997 |

OTHER PUBLICATIONS

"A Guide to Automatic Nozzles", Task Force Tips; Copyright 1995.

* cited by examiner

*Primary Examiner*—Christopher Kim
(74) *Attorney, Agent, or Firm*—Sue Z Shaper

(57) ABSTRACT

A fire fighting nozzle for extinguishing industrial scale fires including improved automatic pressure regulating features, enhanced educting features having central (110) and peripheral channeling (94) for foam concentrate, combined with a capacity to throw dry chemicals. The improved pressure regulating features include a spring (50) loaded double acting baffle (13), that is positioned by fire fighting fluid in communication with a hydraulic chamber, the hydraulic chamber is preferably controlled by a relief valve (42).

25 Claims, 19 Drawing Sheets

FIRE FIGHTING NOZZLE AND METHOD INCLUDING PRESSURE REGULATION, CHEMICAL AND EDUCATION FEATURES

This application is a continuation-in-part of U.S. Provisional Application No. 60/080,846 filed Apr. 4, 1998. Priority is also claimed based on U.S. application Ser. No. 08/991,401 filed on Dec. 16, 1997 which in turn claims priority based on Provisional Application Serial No. 60/032,990 filed on Dec. 16, 1996.

FIELD OF INVENTION

The invention relates to fire fighting and fire preventing nozzles and more particularly to nozzles for extinguishing or preventing large industrial grade fires including flammable liquid fires and/or for nozzles for vapor suppression, and includes improvements in pressure regulating, educting and chemical discharge features, as well as methods of use.

BACKGROUND OF INVENTION

Prior patents relevant to the instant invention include: (1) U.S. Pat. No. 4,640,461 (Williams) directed to a self educting foam fog nozzle; (2) U.S. Pat. No. 5,779,159 (Williams) directed to a peripheral channeling additive fluid nozzle; and (3) U.S. Pat. Nos. 5,275,243; 5,167,285 and 5,312,041 (Williams) directed to a chemical and fluid or duel fluid ejecting nozzle. Also relevant is the prior art of automatic nozzles, including (4) U.S. Pat. Nos. 5,312,048; 3,684,192 and 3,863,844 to McMilian/Task Force Tips and U.S. Pat. Nos. Re 29,717 and 3,893,624 to Thompson/Efkhart Brass. Also of note are U.S. Pat. No. 5,678,766 to Peck and PCT Publication WO 97/38757 to Baker.

Maintaining a constant discharge pressure from a nozzle tends to yield a constant range and "authority" for the discharge while allowing the nozzle flow rate to absorb variations in head pressure. In certain applications, such as vapor suppression, a fire fighting nozzle is useful if it self regulates to discharge at an approximately constant or targeted pressure. The discharge pressure tends to govern what is referred to as the "authority" of the discharge stream and to a certain extent the stream's range, and it can affect the delivery of an appropriate vapor-suppressing fog.

One application in which a self-regulating nozzle may be useful, thus, is a protection system that includes nozzles permanently stationed around locales that could be subject to the leakage of toxic chemicals. Upon leakage such a permanently stationed configuration of nozzles, probably under remote control, would be optimally activated to provide a predesigned curtain of water/fog to contain and suppress any toxic vapors. In such circumstances it may be optimal for the nozzles to discharge their fluid with a more or less constant range and authority as opposed to having their discharge structured and regulated for a relatively constant flow rate, as is more common among fire fighting nozzles. Water/fog created with a more or less constant range and authority while operating under the conditions of varying head pressure from a fixed nozzle will tend to more reliably form a curtain in a preselected region, again which may be useful for containing escaping vapors from a fixed locale.

Typically nozzles are structured to deliver pre-set gallon per minute flow rate assuming a nominal head pressure such as 100 psi at the nozzle. As the head pressure actually available to the nozzle in an emergency varies, flow rate remains more consistent with such design than does discharge pressure. Structuring a nozzle to alternately target and regulate its discharge pressure will let flow rate vary more with variations in delivered pressure, but may be an optimal design for certain circumstances.

The present invention, in one important aspect, discloses an improved pressure regulating nozzle designed within its operating limits to effectively discharge a fire extinguishing fluid at a pre-selected or targeted discharge pressure. According to current practice this targeted discharge pressure would likely be approximately 100 psi. It is to be understood, however, that the preselected targeted pressure could be easily varied, and a target pressure might more optimally be selected to be 120 psi. The instant inventive design improves the efficiency of achieving such a target pressure as well as offers a design that more easily combines with self-educting features for foam concentrates and with the capacity to throw fluid chemicals, such as dry powder, from the nozzle.

In another important aspect the present invention teaches enhanced eductive techniques, for peripheral and central channeling, which enhanced eduction can be particularly helpful in automatic nozzles or when also throwing chemical such as dry powder.

A typical automatic nozzle designed in accordance with the present invention would be designed to operate over a range of flow rates, such as from 500 gallons per minute to 2000 gallons per minute, at a targeted discharge pressure, such as 100 psi. To target a discharge pressure, or to self regulate pressure, the nozzle design incorporates a self-adjusting baffle proximate the nozzle discharge. In general, when fluid pressure at the baffle, sensed more or less directly or indirectly, is deemed to lie below target, the baffle is structured in combination with the nozzle to "squeeze down" on the effective size of the discharge port for the nozzle. When pressure build-up at the baffle, as sensed directly or indirectly, is deemed to reach or exceed a targeted pressure, the baffle is structured to cease squeezing down and, if necessary, to shift to enlarge the effective size of the annular discharge port. Such enlargement would continue, in general, until the discharge pressure reduces to the preset target or a limit is reached. Such adjustments in the size of the discharge port cause the flow rate to vary, but the fluid that is discharged tends to be discharged with a more constant "authority" and range, an authority and range associated with the targeted pressure. The instant design is structured to improve the efficiency and reliability of settling upon or around a target pressure.

The instant invention achieves a pressure regulating system by providing a design with an adjustable baffle having what is referred to herein as forward and opposing or reverse fluid pressure surfaces. Pressure from fluid applied to opposing sides of the baffle causes the baffle to respond, at least to an extent, as a double acting piston, although perhaps in a complex manner. The so called forward and reverse directions are referenced to the nozzle axial direction with forward being in the direction of fluid discharge. The forward and reverse pressure surface areas provided by the baffle preferably are not equal. In preferred embodiments the effective pressure surface area of the reverse side exceeds the effective pressure surface area of the forward side. Thus, were the pressure on both surfaces equal, the baffle would automatically gravitate to its most closed position, minimizing or closing the discharge port.

The effective forward pressure surface area will likely, in fact, vary with pressure and with flow rate. Limited experience indicates that the forward fluid pressure surface area also varies with bafflehead design and nozzle size. Further, in preferred embodiments, although pressure from the primary fire fighting fluid, directly or indirectly, is applied to both forward and opposing fluid pressure surfaces, the value of the reverse pressure is usually less than, although a function of, the pressure on the forward surface.

A relief valve is preferably provided, such that at or slightly past a targeted pressure the valve can begin to relieve the effective pressure on (at least) one side of the baffle. At least one relief value promises to enhance responsiveness. In preferred embodiments the one side of the baffle upon which pressure is relieved would be the reverse side, the side opposing the forward pressure of the primary fluid on the bafflehead. Specifically, in such an embodiment, when the pressure of the primary fire extinguishing fluid proximate the nozzle discharge causes the pressure sensed by whatever means by the relief valve to exceed a preselected value, reverse pressure is relieved on the interior baffle chamber surfaces and the baffle tends to forwardly adjust in response to forward fluid pressure. Alternately, the baffle might simply stabilize at a balanced pressure position in preferred embodiments, with or without the (or a) relief valve slightly bleeding. That is, a nozzle could be designed to achieve a balanced pressure baffle position with or without a relief valve and with or without any bleeding of a relief valve. Use of at least one relief valve, and a bleeding relief valve, are practical expedients.

To continue the prior example, adjustments forward of a bafflehead may continue until the primary forward fluid pressure at the bafflehead, as sensed directly or indirectly, decreases to or diminishes below a preset relief valve value. Thereupon a closing of the relief valve would be triggered. The bafflehead might stabilize, or if stabilization were not achieved, could adjust backwardly with the relief valve either bleeding or closed, depending on the design, thereby decreasing the effective size of the nozzle discharge port.

To summarize operations, as the bafflehead adjusts forward and backward, as described above, the discharge pressure declines and increases, respectively. If a discharge pressure declines to, or below, a pre-selected amount, as sensed directly or indirectly, in preferred embodiments as described above, a relief valve would be set so that it tends to close. Closing the relief valve would increase reverse pressure on the baffle. Alternately if a sensed delivered pressure is deemed to increase above a preselected amount, the (or a) relief valve would preferably be set so that it tends to open. With the assistance of the opening and closing of a relief valve, a bafflehead can be encouraged to quickly and efficiently gravitate toward a balanced location wherein the effective pressure on the bafflehead in the forward direction offsets the effective pressure on the bafflehead in the reverse direction, taking into account the degree of openness, and any bleeding, of a relief valve or valves, as well as other factors of the design and the supplied pressure. Of course, other biasing factors on the bafflehead, such as springs, etc. could be present and would have to be taken into account.

Again, assuming that the reverse pressure surface area afforded by the bafflehead chamber is larger than the effective forward pressure surface area afforded by the bafflehead, and that the reverse side of the baffle is supplied with a measure of fluid pressure from the primary fire fighting fluid as delivered to the nozzle then a bafflehead and nozzle could be designed (ignoring the effects of any relief valve activation) so that as the pressure of the fire extinguishing fluid through the nozzle decreases, the bafflehead adjusts in the reverse direction until it either closes or hits a stop or balances (or triggers a relief valve). Squeezing down on the size of the discharge port raises discharge pressure. Again, as stated above, a design could incorporate, without any relief valves, a balanced pressure position where, at target pressure, the effective pressure on the baffle forward pressure surface offsets the effective pressure on the opposing reverse baffle surface. The design would take into account the fact that the pressures and the areas would be different and would typically vary. In general, however, the bafflehead forward surfaces and reverse surfaces together with the nozzle discharge structure, baffle structure and any relief valves and any other supportive biasing means, should be designed and structured in combination such that a targeted discharge pressure is effectively and efficiently achieved without undue hunting. As mentioned above, a relief valve or valves likely improve the efficiency of the design and, at the balance point, might be optimally structured to be slightly open, or bleeding.

Further to summarize operations, pressure forward on the bafflehead is the product of the delivered fluid pressure at the effective bafflehead deflecting surface times the effective baffle forward surface area. The opposing pressure on the bafflehead is the fluid pressure developed against the bafflehead opposing surface (preferably the primary fluid operating within a baffle chamber) times the opposing bafflehead surface area. The opposing surface area is preferably larger than the effective forward surface area, and reverse fluid pressure, such as developed within a baffle chamber, is likely less than, although a function of, the delivered fluid pressure at the bafflehead. As stated above, while it is possible to design a self adjusting bafflehead in combination with a nozzle structure such that a bafflehead balances at a targeted pressure without the assistance of any relief valves, a relief valve likely facilitates the speed, sensitivity and efficiency of the design for most nozzle sizes. So, using one or more relief valves, a valve trigger pressure would be selected such that, when fluid pressure on forward baffle surfaces appears to a sensing device to begin to significantly exceed the target pressure, the relief valve opens or at least begins to open. At such point the valve relieves or begins to relieve fluid pressure on one baffle surface, such as the reverse surface, allowing the baffle to stabilize or to begin to readjust. The readjustment affects fluid discharge pressure at the discharge port. One preferred design includes structuring of bafflehead surface area and a relief valve in combination such that with the relief valve closed, the bafflehead essentially closes the nozzle; further, the bafflehead balances at a targeted delivery pressure with the relief valve partially open or bleeding. With the relief valve completely open, the bafflehead would move to its fully open position.

The present invention has at least three objectives. One objective is to provide an automatic self adjusting nozzle that can accurately, speedily and reliably control nozzle discharge pressure to within a small range. A second objective is to provide a self adjusting nozzle design that adjusts smoothly and accurately in both directions. that is both from a too high pressure situation and from a too low pressure situation toward a target pressure. Structure to accomplish these two objectives has been discussed above. Third and further objectives are to provide an enhanced self educting nozzle design, valuable in its own right and also so that a self-adjusting nozzle can be efficiently combined and incorporated into a self-educting foam/fog nozzle. In addition the enhanced eductive design is useful to incorporate with a nozzle incorporating a capacity for throwing fluid chemicals, such as dry powder. Thus, the invention also relates to improved educting features applicable to various nozzles.

SUMMARY OF THE INVENTION

The invention includes a pressure regulating nozzle for extinguishing fires comprising a baffle adjustably located proximate a nozzle discharge. The baffle provides forward and opposing pressure services in fluid communication with a primary fire extinguishing fluid. The baffle adjustment is affected, at least in part, by fluid pressure upon the forward and opposing baffle surfaces.

Preferably the nozzle includes a relief valve and the effective opposing pressure surface areas of the bafflehead are larger than the effective forward pressure surface areas. Preferably the baffle defines a baffle chamber and the relief valve, if one is utilized, is located at least partially within the baffle chamber.

The invention includes incorporating fluid educting features into the self adjusting nozzle. The fluid educting features are designed particularly for foam concentrate and could provide either central or peripheral channeling of the foam concentrate.

Preferably also the present invention provides for incorporating a capacity to throw dry chemical with the self adjusting nozzle and the self adjusting and self educting nozzle.

The invention also provides for enhanced educting features when the second fluid or foam concentrate is channeled peripherally around the wall. These enhanced educting features could be utilized with or without a self adjusting bafflehead. The enhanced educting features include shaping the primary fire fighting fluid stream proximate a nozzle discharge to form an annular stream having a gradually diminishing cross sectional area. The eductive port for the second fluid or foam concentrate opens onto the annular stream just downstream of the minimum of the cross sectional area. The annular stream gradually expands subsequent to reaching the minimum. Additionally small jets for the primary fire fighting fluid may be provided through the peripheral channeling walls to enhance eduction of the second fluid or foam concentrate.

BRIEF DESCRIPTION OF THE DRAWINGS

A better understanding of the present invention can be obtained when the following detailed description of preferred embodiments are considered in conjunction with the following drawings, in which:

in FIG. 4A a self-educting pressure regulating nozzle is indicated where a relief valve has been designed as an annular relief valve encircling the tube that provides educted fluid into a mixing type area of the nozzle. A flow meter is illustrated having an attachment to a visible indicator on the outside of the nozzle, the flow meter itself indicated as residing within the baffle.

Figure 1:
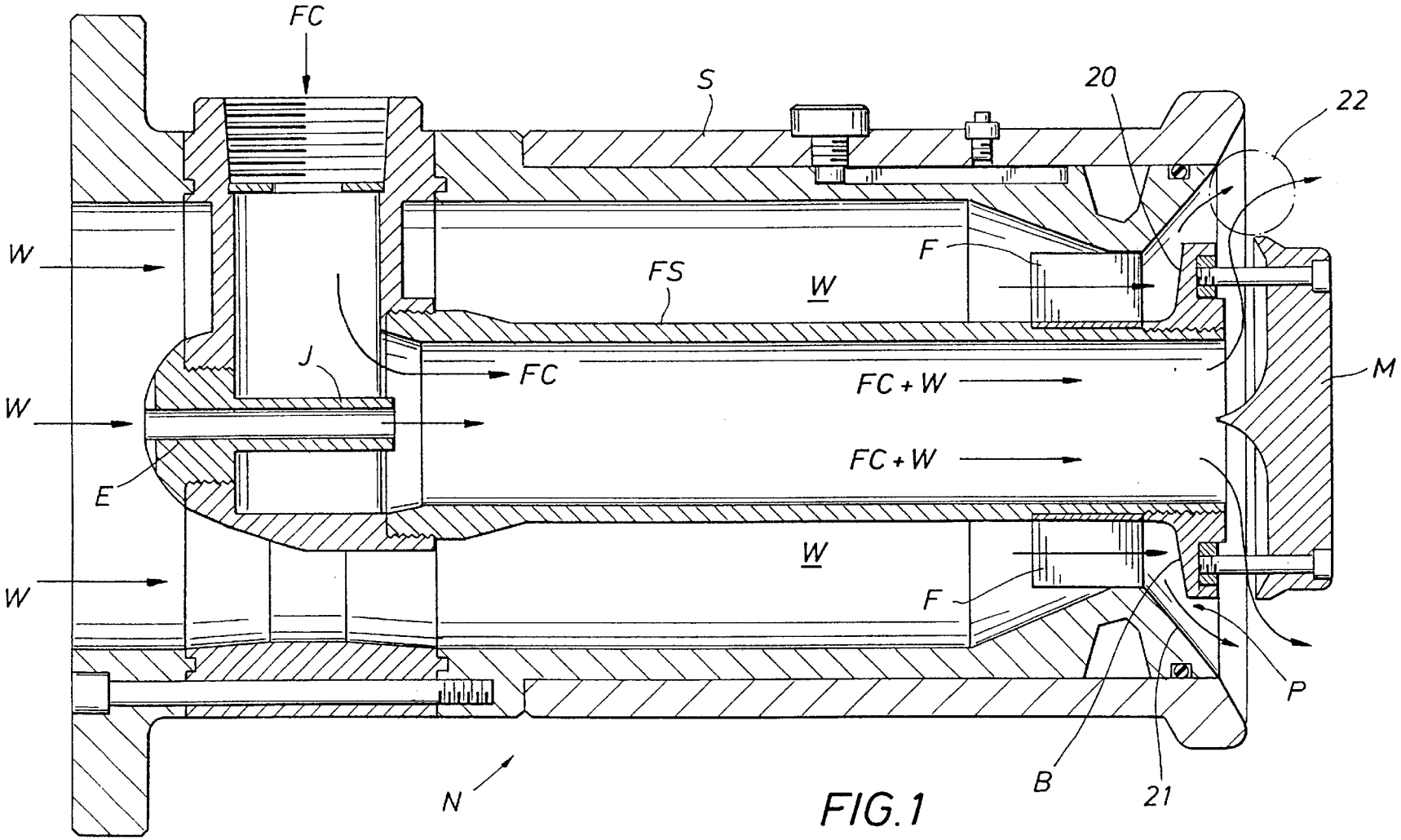
FIG. 1 (PRIOR ART)
FIG. 1 illustrates in cutaway form, for background purposes, typical structure of a prior art self-educting nozzle that is not self-adjusting.

The drawings are primarily illustrative. It should be understood that structure may have been simplified and details omitted in order to convey certain aspects of the invention. Scale may be sacrificed to clarity.

DETAILED DESCRIPTION OF THE PREFERRED EMBODIMENTS

In general, a nozzle having an "adjustable" baffle in order to discharge fire extinguishing fluid at a targeted pressure requires a biasing means opposing a natural movement of an adjustable baffle outwards in response to fluid pressure, which outward movement tends to open the effective size of the discharge port. Most simply the biasing means biases with a backward force equal to the force of the desired or targeted fluid pressure upon the forward baffle surfaces. Hence baffle forward movement balances against baffle backward bias pressure at the targeted pressure. Forward baffle surfaces are surfaces that the baffle presents to the fire extinguishing fluid moving through and out of the discharge port. In theory, the biasing force could be provided by a spring that, over the adjustment range of the baffle between its end points, which may be no more than approximately one half of an inch, presents, an essentially constant biasing force at the targeted pressure. The target pressure might well be 100 psi. Such simple design is indicated in FIG. 4B.

Alternately, an adjustable bafflehead could be designed defining a chamber within the bafflehead and presenting forward and backward surfaces against which the primary fire extinguishing fluid could act. It is understood that the chamber defined within the bafflehead would have means for permitting a portion of the fire extinguishing fluid to enter the chamber. In such designs the effective backward pressure surface area would usually exceed the effective forward pressure surface area of the baffle. The fluid pressure within the baffle, however, is expected to be at least slightly less than the pressure exerted on forward facing baffle surfaces. Such tends to counter the fact that the backward pressure surface area presented to the fluid within the baffle, at least in preferred embodiments herein, exceeds the forward pressure surface area presented on the baffle. In such manner the fluid within the baffle acts against a greater surface area and, although lower in value, can potentially drive the baffle backwards against the flow of fluid through the nozzle. Anticipating the difference between the pressures, without and within the baffle, at different source pressures, and anticipating the difference in the effective areas presented to the fluid pressures at different head pressures and flow rates, leads to a design for a "balanced baffle" at a targeted fluid pressure. Spring mechanisms can always be added, it should be understood, to augment the biasing forces provided by the primary fire extinguishing fluid pressure upon the bafflehead forward and backward surfaces.

It should be understood that if or when baffle adjustment results in a variation of the volume of the defined baffle chamber, as by the baffle sliding over a fixed piston, relief will be provided to vent fluid from inside the chamber.

The present invention discloses in particular the use of at least one relief valve in order to heighten the accuracy and speed of balance and to lessen undue hunting or hysteresis. A relief valve vents fluid pressure from one or the other side of the baffle, preferably from within the baffle chamber, when fluid pressure varies from target pressure. Such venting typically causes the baffle to move, as in an illustrated case, outward toward one of the baffle location end points. A movement outward or toward the outward end direction will cause a decrease in the fluid pressure upon the baffle. Such decrease in fluid pressure could cause the relief valve to again close, permitting again the buildup of fluid pressure upon the back side of the baffle. The build up of fluid pressure upon the back side of the baffle should help adjust the baffle toward a balanced position where the fluid pressure on the forward surfaces of the baffle balances the fluid pressure on backward surfaces of the baffle, including taking into account other biasing elements such as a continuously "bleeding" relief valve and any springs utilized in the design.

The relief valves illustrated for the instant embodiments sense either rather directly the primary fire extinguishing fluid pressure presented to forward baffle surface areas in the nozzle or sense more indirectly a more secondary fluid pressure generated within a chamber within the baffle. The difference between such designs, or other designs that could occur to those of skill in the art, can largely be a matter of design choice and simplicity of engineering.

One function selected for a relief valve could be to assist in achieving the situation where a balanced pressure position is consistently approached from the same direction, which could either be the moving outwardly or the moving inwardly the baffle. Such a design may facilitate engineering a higher degree of accuracy around the balance point with less hunting and greater speed in achieving balance.

The present invention also teaches improved self educting features that are particularly helpful and useful in a pressure regulated nozzle, as well as enhanced educting and pressure regulating designs that are useful when throwing fluid chemical such as dry powder, with or without an automatic nozzle.

FIG. 1 illustrates a standard self educting nozzle. FEF indicates a fire extinguishing fluid. Fire extinguishing fluid FEF educts foam concentrate FC by means of eductor E into central fixed stem FS of nozzle N. The mainstream of the fire extinguishing fluid FEF, which is usually water W, flows by fins F, is deflected outwardly by forward baffle deflecting surface 20 and flows out the gap or nozzle discharge part P. Foam concentrate FC and a small amount of fire extinguishing fluid FEF that flows through eductor E by means of jet nozzle J flows through the stem and past mixing plate M, thereafter to mix with the main body of fire extinguishing fluid FEF flowing out of the gap or port P in the nozzle into mixing area 22. Sleeve S adjusts from a backward position shown in FIG. 1, for throwing a fog pattern, to a forward position for throwing a "straight stream" pattern. Port P is defined by surface 20 of baffle B and by surface 21 of nozzle N. Nozzle N can be an assembly of parts.

Figure 2A:
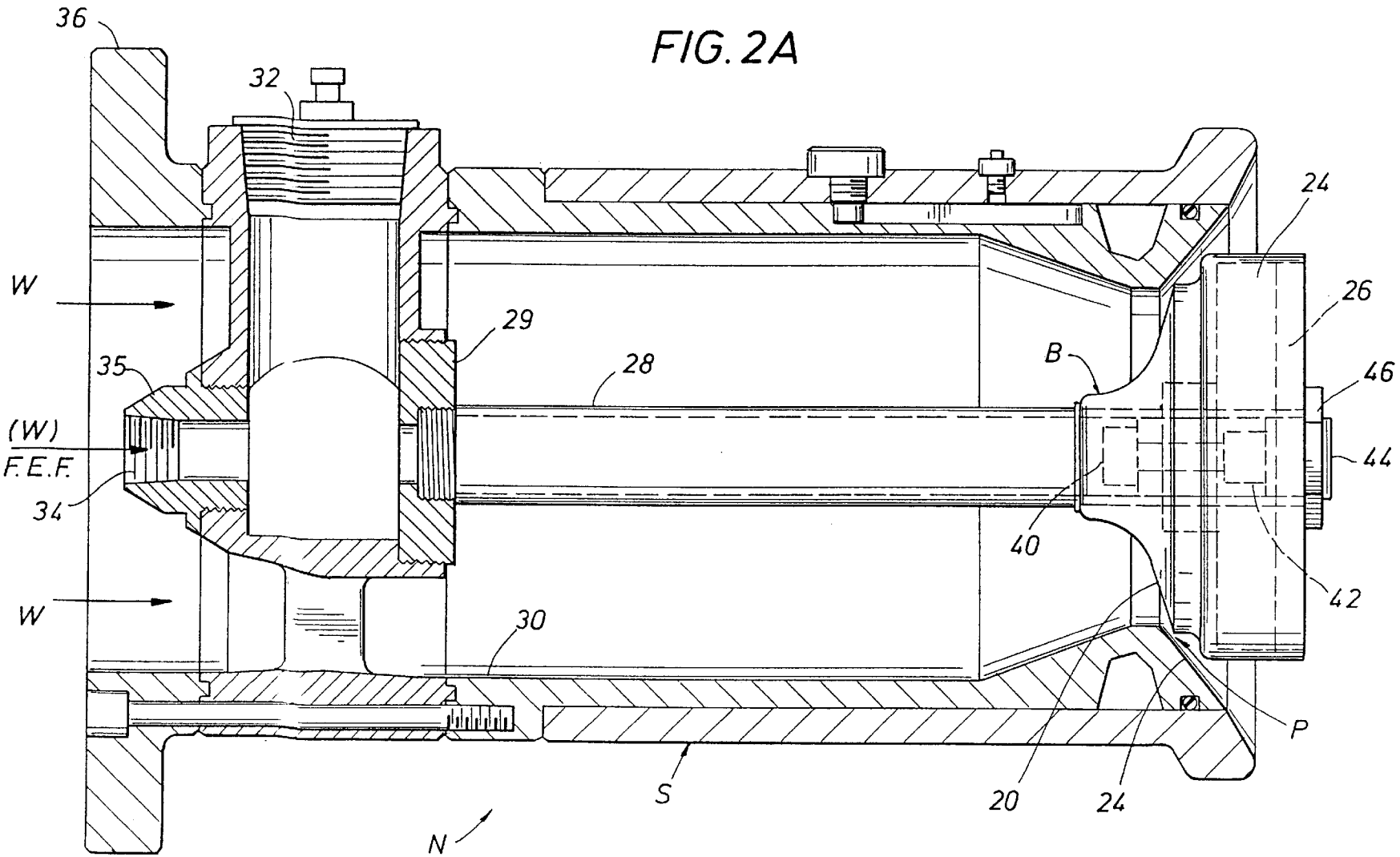
FIG. 2A illustrates in cutaway form one embodiment for a self-adjusting nozzle, the embodiment having a centralized relief valve.
Figure 2B:
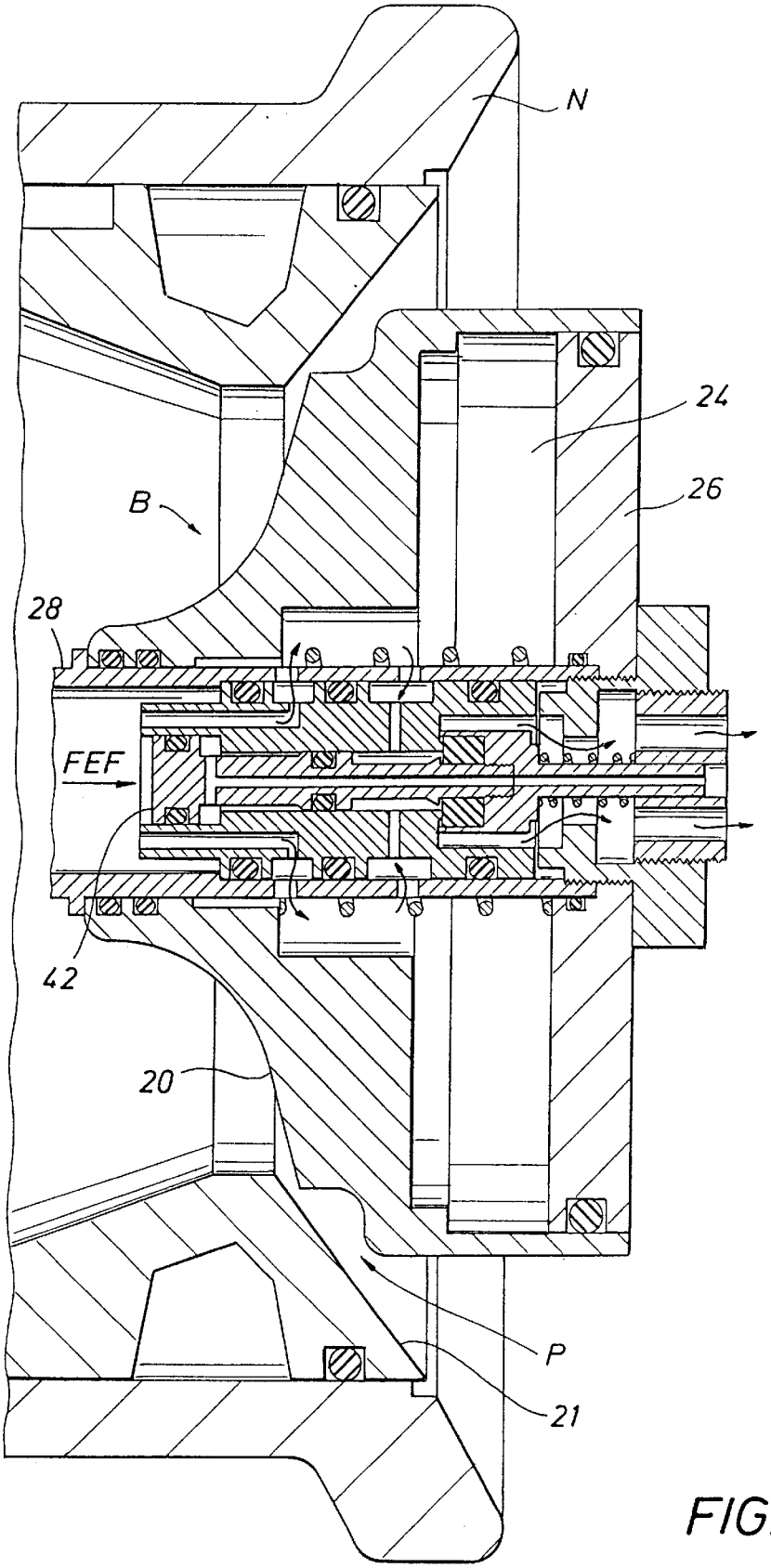
FIG. 2B illustrate in cutaway form an enlarged detail of FIG. 2A, namely an embodiment of an adjustable bafflehead with a centrally located pilot relief valve.
Figure 2C:
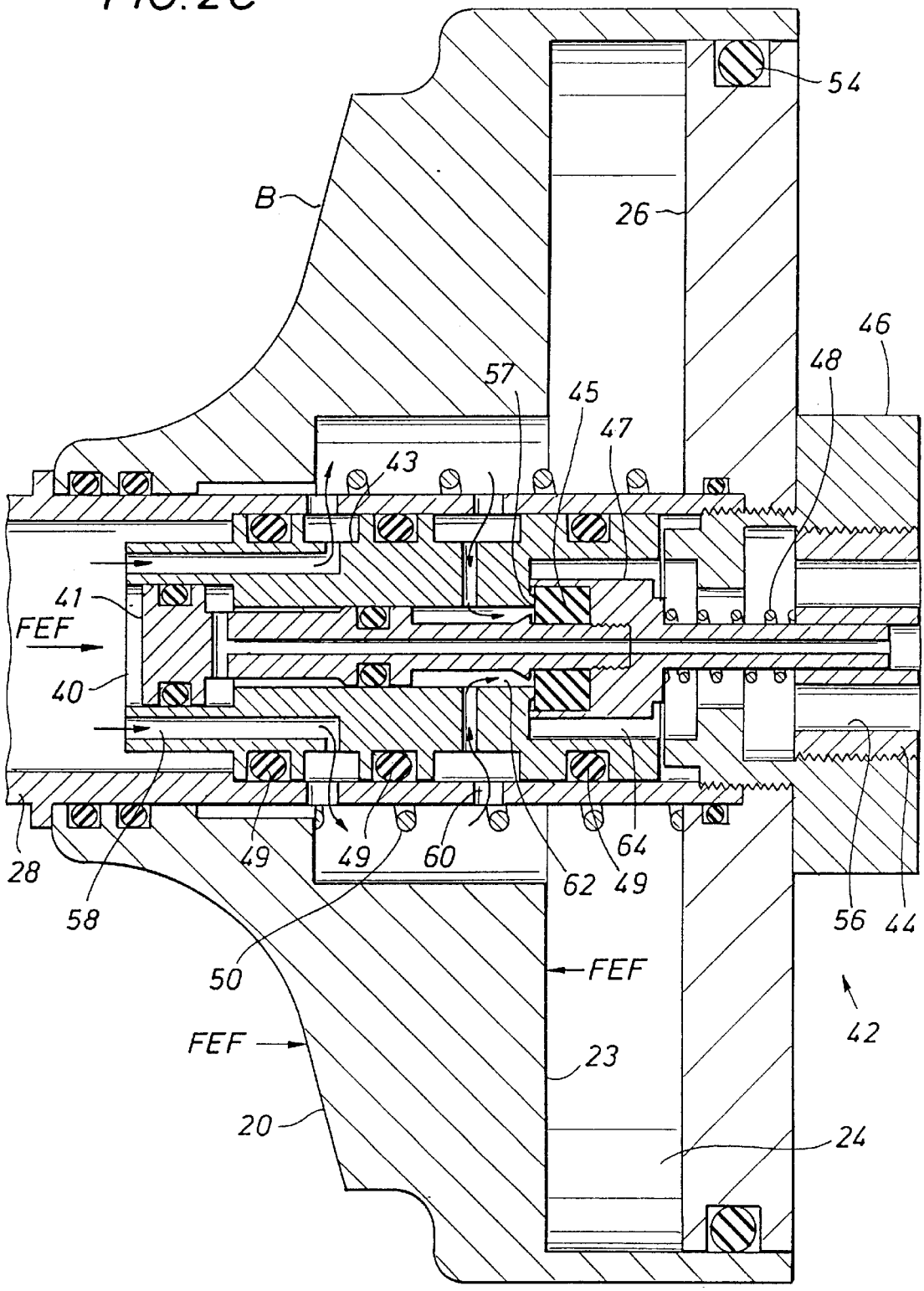
FIG. 2D also illustrates in cutaway form an embodiment for a self-adjusting nozzle having a non centrally located pilot relief assembly.
Figure 2D:
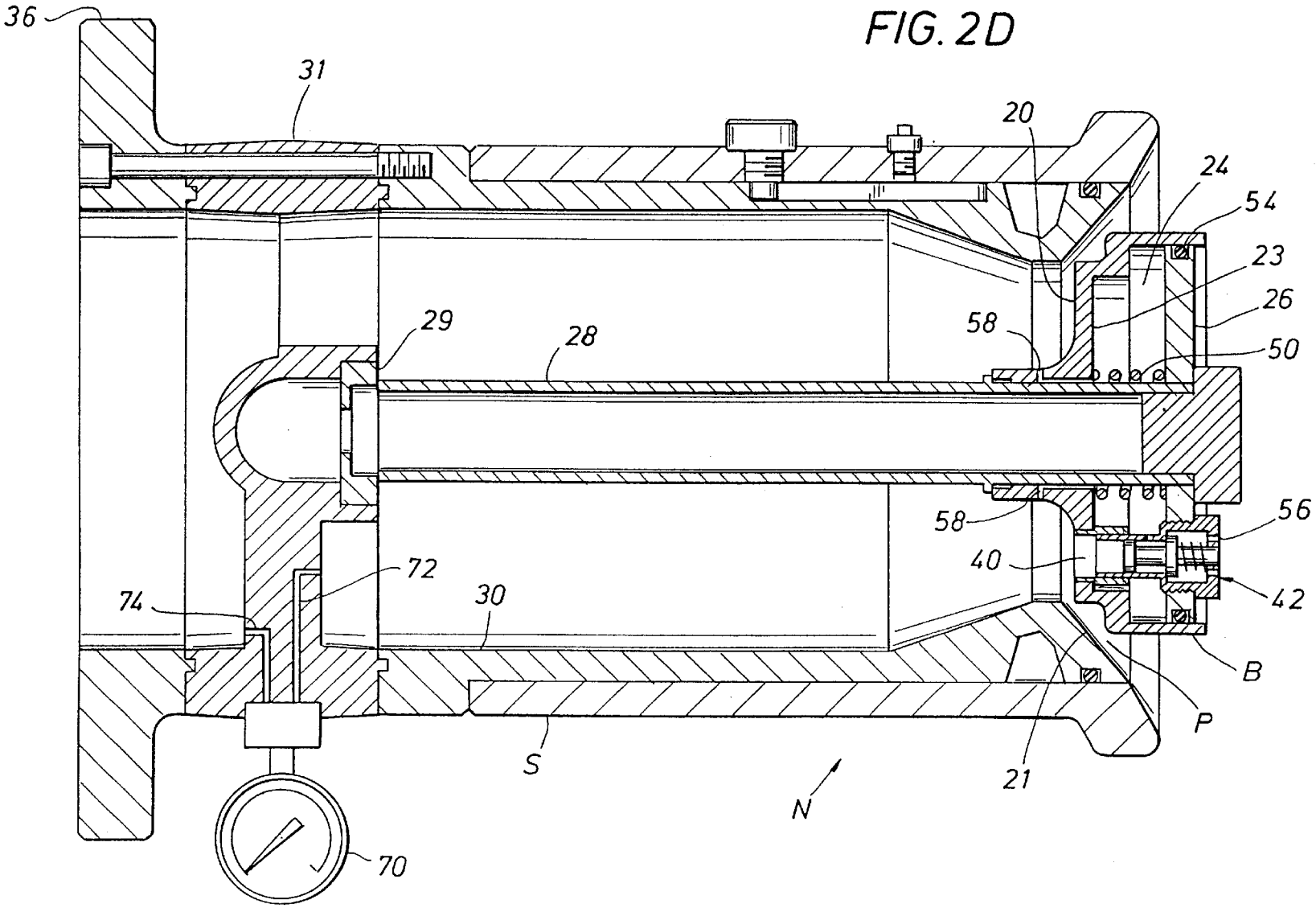

FIGS. 2A, 2B and 2C illustrate a pressure regulating or self-adjusting or automatic nozzle N built using a basic structure of a self educting nozzle, but with the foam eduction inlet closed off by module 32. (Photos in the provisional application, above referenced, illustrate the embodiment of FIGS. 2A, 2B and 2C. The photos include the springs utilized.) FIGS. 2A, 2B and 2C are particularly useful in disclosing one embodiment of the automatic pressure regulating feature. The nozzle of FIGS. 2A, 2B and 2C enjoys the simplicity that it is neither self-educting nor is structured to throw dry chemical. In the embodiment of FIGS. 2A, 2B and 2C pilot or relief valve 42 is utilized. The simple design permits the pilot or relief valve to be centered in the stem of the nozzle. Were the center of the nozzle to be utilized to channel either foam concentrate or dry chemical, then a pilot valve associated with the self-adjusting baffle would be better located off center on the baffle. Such alternate design is illustrated in FIG. 2D, which is also an embodiment of an automatic nozzle without provision for either educting foam or throwing dry chemical, although it could easily be modified to do so. It can be seen that the automatic feature design of FIG. 2D lends itself to educting foam concentrate or channeling dry chemical through the center of the nozzle.

Nozzle N of FIG. 2A illustrates adjustable bafflehead B sliding over fixed support stem 28. Support stem 28 is anchored in stem adapter 29. Fire extinguishing fluid FEF or water W enters nozzle N from the left and flows to the right, exiting port P between surface 20 defined by bafflehead B and surface 21 defined by an element of nozzle N. Provision is made for fire extinguishing fluid to enter the center of support stem 28 thereby pressuring a surface of pilot 42 located essentially within bafflehead B. Pilot 42 presents pilot pressure surface port 40 to expose a pressure sensing surface to the fire extinguishing fluid or water that enters the support stem 28 of nozzle N.

Piston 26 at the end of support stem 28 is fixed, like support stem 28. Bafflehead B defines a baffle chamber 24 within interior portions of bafflehead B, utilizing fixed piston 26 to form one end of the chamber. A filter 34 is preferably provided to the water inlet of support stem 28 to keep debris from blocking the pilot pressure surface in port 40. Flanged base 36 is known in the art as a means for connecting a nozzle N to a supply of fire extinguishing fluid or water. Filter 34 can be retained by filter retaining nut 35.

FIG. 2C more clearly illustrates the operation of pilot valve 42. Fire extinguishing fluid FEF is present within fixed stem 28 and presses upon pilot control surface 41 within sensing pressure inlet port 40. Fire extinguishing fluid FEF also enters bafflehead B interior chamber 24 via side inlet ports 58 as illustrated by the arrows in FIG. 2C. Side inlet ports 58 of the embodiment of FIG. 2C are on the outside of pilot control surface 41. Sliding bafflehead B, sliding over fixed piston 26, is pushed forward by the pressure of fire extinguishing fluid against forward baffle surface 20 and is pushed backwards by the pressure of fire extinguishing fluid within baffle chamber 24 against reverse or opposing bafflehead surfaces 23. In operation reverse surfaces 23 in the embodiment of FIG. 2C present a greater effective surface area than forward bafflehead surfaces 20, when taking into account the flow of the fluid, from bottom to top in FIG. 2C, past bafflehead B. A bafflehead reset spring 50 is shown which resets the bafflehead to its closed position absent overriding water pressure. The pressure of the fire extinguishing fluid inside bafflehead chamber 24 is less than the pressure of the fire extinguishing fluid upon forward surfaces 20 of bafflehead B, as determined by testing.

Pilot control surface 41 in pressure inlet port 40 is biased by pilot bias spring 48. Pilot bias spring 48 sets the value at which the pilot valve opens or at least bleeds. When the pressure against pilot control surface 41 creates a force that overcomes the biasing pressure of pilot bias spring 48, the piston of pilot valve 47 with pilot seal 45 moves forward in the direction of nozzle flow, opening pilot valve 47. Fire extinguishing fluid FEF within bafflehead 24 enters ports and fills chamber 62 within pilot valve 42. When pilot valve 47 opens, fluid from pilot valve chamber 62 flows through pilot valve chamber 64 and further forward and out atmospheric vent holes 56. Piston retaining nut 46 holds fixed piston 26 on fixed stem 28. Floating bafflehead B slides past fixed piston 26 and is sealed by main seal 54 against the surface of fixed piston 56. If or when pilot valve 47 only opens a slight amount then pilot 42 will bleed or leak slowly through chambers 62, 64 and out atmospheric vent holes 56. As fluid is allowed to move out of bafflehead chamber 24 through chamber 62 and chamber 64 and atmospheric vent holes 56 within the pilot valve, pressure is relieved against opposing or reverse interior bafflehead surface 23. As pressure is relieved against surface 23 the force of fire extinguishing fluid pressure against surface 20 can slide bafflehead B forward over fixed piston 26. Guide element 43 of pilot valve 42 serves to guide the movement of the piston of pilot valve 47 within pilot valve 42. Guide 43 can be sealed against fixed stem 28 with guide seals 49. Spring tension adjustment screw 44 can be provided to vary the bias of pilot bias spring 48.

FIG. 2D illustrates an analogous sliding adjustable bafflehead B having an off center pilot relief assembly 42. Pilot relief assembly 42 senses pressure at portions of forward baffle surface 20 of sliding bafflehead B. Pressure is sensed through a sensing pressure inlet port 40 provided for pilot relief assembly 42. Flow indicators 70 are illustrated in FIG. 2D utilizing sensors 74 and 72 to give a visual indication and readout of flow to operator. Water inlets 58 in FIG. 2D provide ingress into interior bafflehead chamber 24 for the primary fire extinguishing fluid in order to create a reverse pressure or backward pressure against sliding bafflehead B.

Figure 3A:
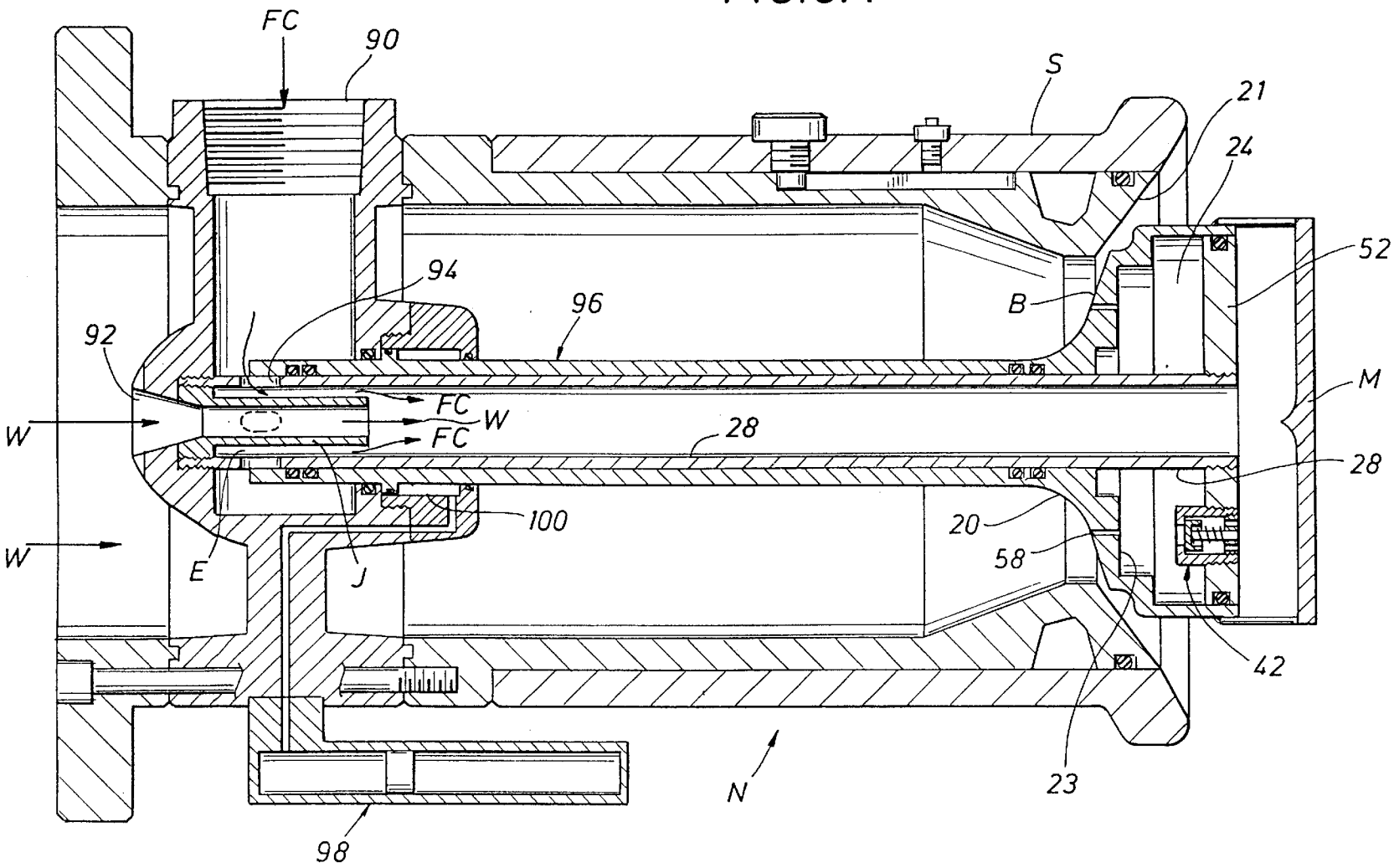
FIG. 3A illustrates in cutaway form an embodiment of a self-educting and self-adjusting nozzle, including transporting and discharging foam concentrate through the center of the nozzle and having a pilot relief assembly that senses pressure within a baffle chamber.
Figure 3B:
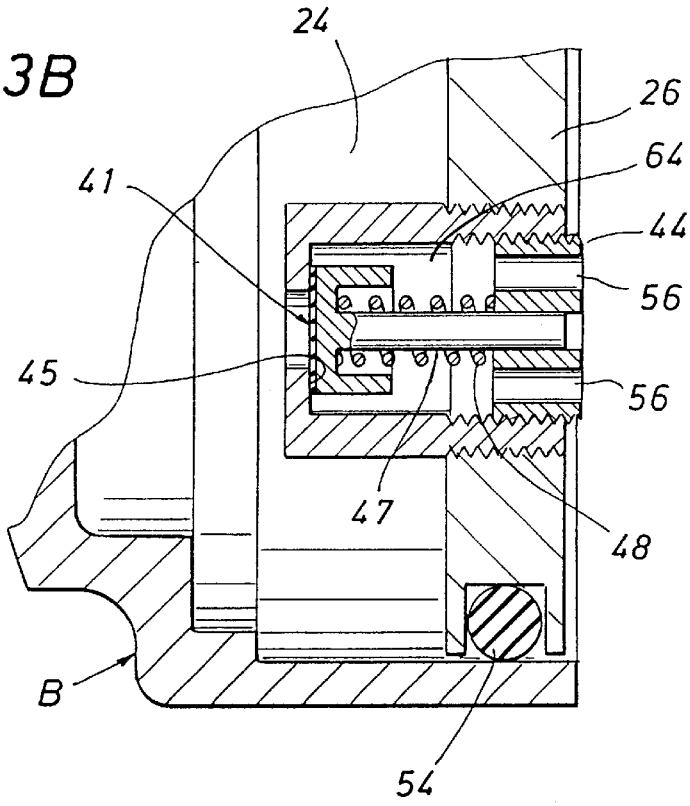
FIG. 3B illustrates in greater detail a pilot relief assembly as in FIG. 3A wherein pressure is sensed within a baffle chamber.

FIGS. 3A and 3B illustrate a self educting pressure regulating nozzle where foam concentrate FC is channeled centrally through slidable flow metering tube 96 and fixed stem 28. In the preferred design of FIGS. 3A and 3B water W, the typical primary fire extinguishing fluid, enters baffle chamber 24 by means of water inlets 58, passing from the forward surface 20 of the bafflehead B into the chamber 24 and around the backward facing surface 23 of bafflehead B. The pilot relief valve assembly 42 of the embodiment of FIG. 3A senses pressure of the fire extinguishing fluid or water W within the baffle chamber 24. FIG. 3B offers an enlargement of pilot relief assembly 42 of FIG. 3A. In the instant design the pilot relief valve or poppet valve 47 is spring biased by pilot bias spring 48 so that the poppet 47 moves from its seat 45 and relieves pressure at one selected relief valve pressure, which in preferred embodiments might be set at about two thirds of a targeted 100 psi nozzle head pressure. Such a value, experience has indicated, is appropriate for a relief valve sensing fire extinguishing fluid pressure within a baffle chamber of a nozzle. The spring biasing pressure set for fluid pressure within the baffle chamber, as in FIG. 3B, existing tests and experience indicate, would run appropriately 65 psi in order to reach the proper balancing of inward and outward fluid pressure upon forward and backward baffle surfaces to achieve a target pressure of approximately 100 psi while taking into account other biasing such as may be used to return a baffle to a closed position with no flow of water therethrough.

In FIG. 3B when force against pilot control surface 41 is greater than the force of pilot spring 48, pilot relief valve 47 opens emitting fluid from within baffle chamber 24 to flow through pilot relief valve or poppet chamber 64 and out atmospheric vent holes 56. Again, depending upon design, intent and the pressures involved, the pilot relief valve might bleed slightly or open fully.

FIG. 3A incorporates a slidable flow metering tube 96 that slides with bafflehead B over fixed stem 28. Flow metering tube 96 slides over fixed foam metering orifice 94. Foam metering orifice 94, according to its degree of openness, affects the amount of foam educted through foam inlet 90 by water W proceeding through inlet jet 92 and through eductor jet J. In such manner, the relative position of the sliding bafflehead B over stem 28 and within nozzle N can effect the metering or the amount of foam educted through stem 28 and tube 96. FIG. 3A further illustrates the option of adding a gauge float assembly 98 connected to a gauge feed pump assembly 100. Foam concentrate FC flows through foam inlet 90 and into stem 28 through foam metering orifice 94. The degree of openness of foam metering orifice 94 depends upon the relative longitudinal setting of bafflehead C and connected foam metering tube 96.

Figure 3E:
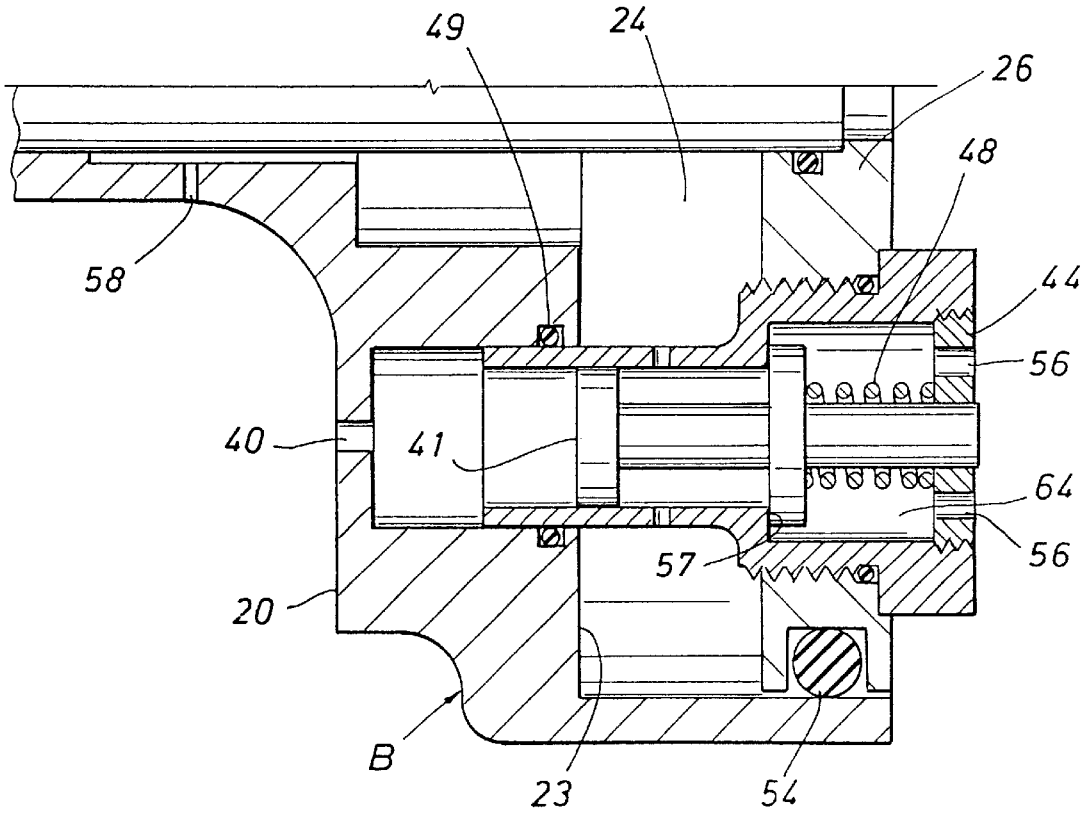
FIG. 3E illustrates in cutaway a detail of FIG. 3D, namely, a non-centrally located pilot relief assembly for sensing pressure at a baffle forward surface area.
Figure 3C:
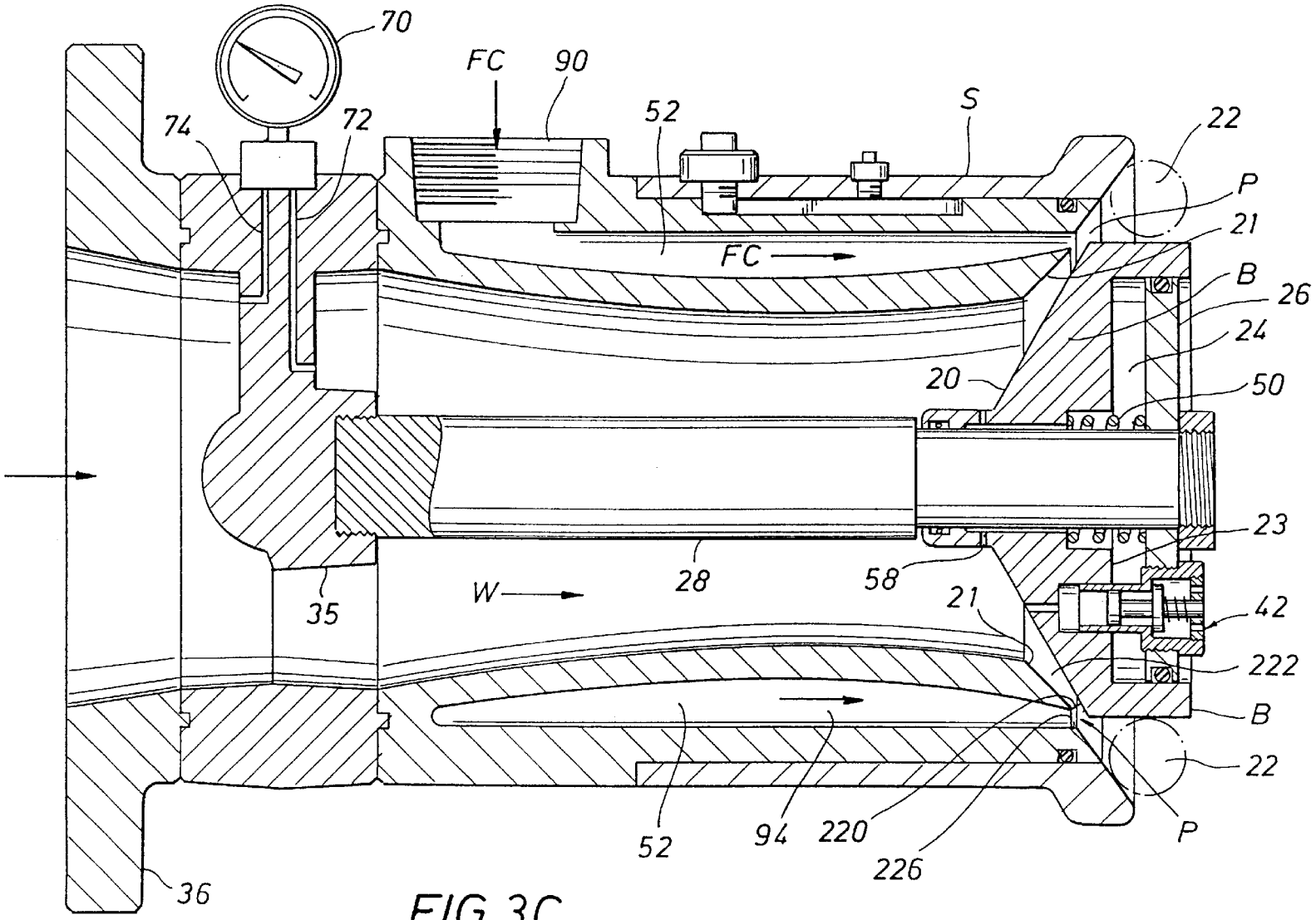
FIG. 3C illustrates an embodiment of an automatic nozzle that provides for educting foam concentrate and for peripherally channeling the educted foam concentrate; a pilot relief assembly is illustrated that senses pressure along forward bafflehead surface areas.
Figure 3D:
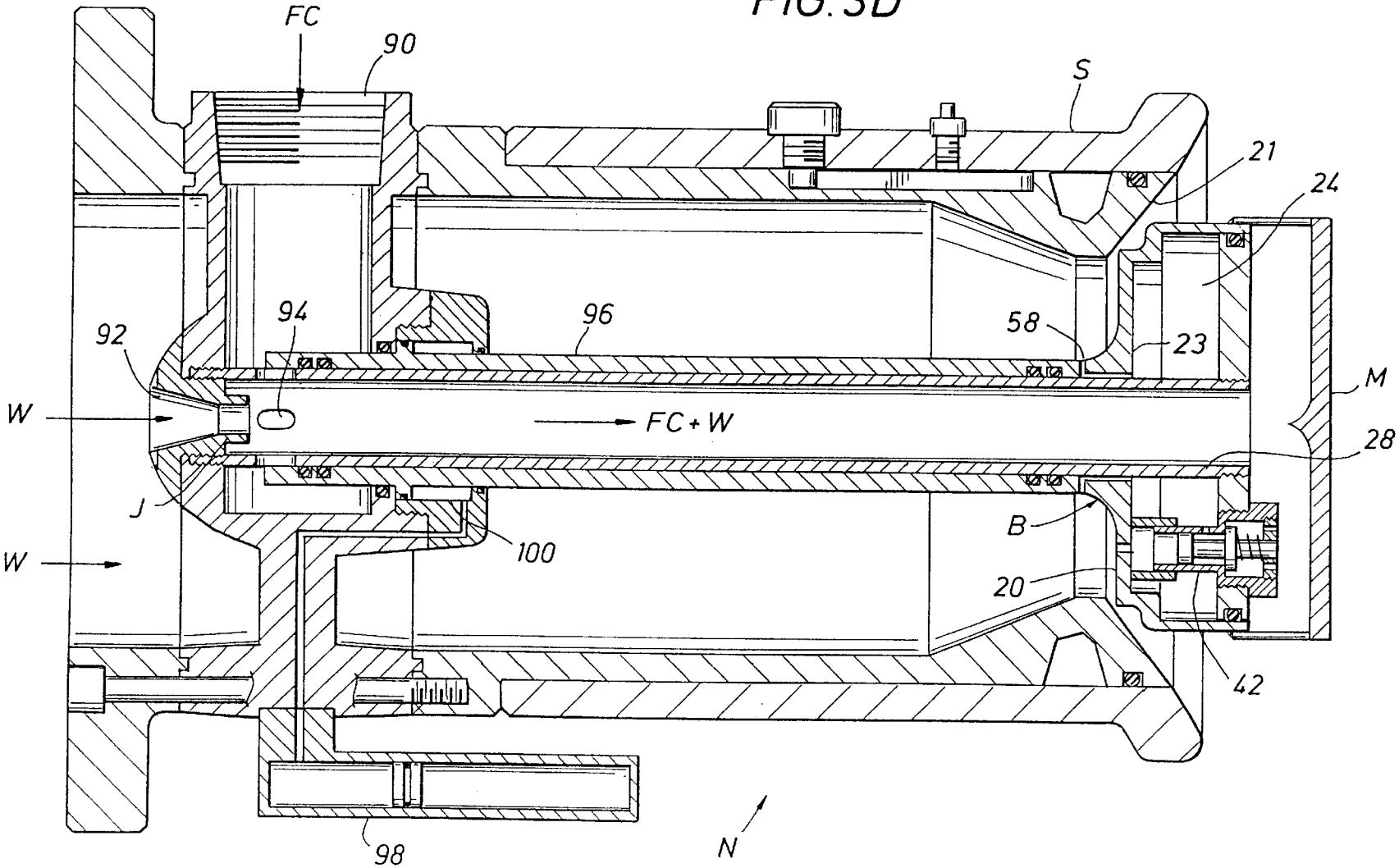
FIG. 3D illustrates in cutaway form an embodiment of an automatic nozzle providing for educting foam concentrate with central channeling for the foam concentrate; a pilot relief assembly is illustrated that senses pressure at a baffle forward surface area.

The embodiments of FIGS. 3D and 3E are similar to the embodiments of FIGS. 3A and 3B. The difference is that pilot relief assembly 42, in the embodiments of FIGS. 3D and 3E, senses water pressure more or less directly at floating bafflehead B forward surface 20.

The embodiment of FIG. 3C illustrates an automatic nozzle providing for self educting foam concentrate but peripherally channels the foam concentrate around portions of the nozzle barrel wall, in lieu of centrally channeling the foam. The central stem in FIG. 3C is illustrated as solid. The central stem could, of course, be utilized as a channel for channeling chemical such as dry powder through the nozzle.

The pilot relief assembly 42 of the embodiment of FIG. 3C is similar to that of the embodiment of FIG. 3D. Bafflehead B slides on fixed support stem 28 as in the embodiment of FIG. 2A. Again a flow indicator 70 is illustrated for providing a visual readout of flow through the nozzle. In the embodiment of FIG. 3C foam concentrate FC enters foam inlet 90 and is channeled through peripheral channels 52 to the discharge end of nozzle N. Foam concentrate FC follows a path through peripheral channels 52, which could well be an annular channel ending an annular foam outlet 27. An enhanced or improved educting feature is illustrated in FIG. 3C. Nozzle surface 21 and bafflehead surface 20 serve to shape the exiting water stream W. Water stream W is shaped by surfaces 21 and 20 to form a relatively smooth annular stream with a diminishing width across sectional areas down to a minimum width achieved just prior to passing over and past foam outlet 27. The cross sectional width of the annular stream of the water slightly widens when and after passing foam outlet 27. This accommodates the small amount, typically 3 to 6 percent, of foam concentrate educted into the major water stream W. Water W and the appropriate amount of foam concentrate FC then exit together at port P, the foam concentrate being educted through foam outlet 27 by the passage of water W through the minimum point having width 220, port gap or port P and out into general mixing area 22. Mixing area 22 is indicated rather amorphously by dashed lines. Tests and experience have indicated that the educting force achieved by water W passing over foam outlet 27 is enhanced when the exiting stream is shaped into a relatively smooth annular stream with a diminishing cross sectional area in region 222 over a distance of approximately two times to five times the width 226 of foam outlet 27.

Figure 4A:
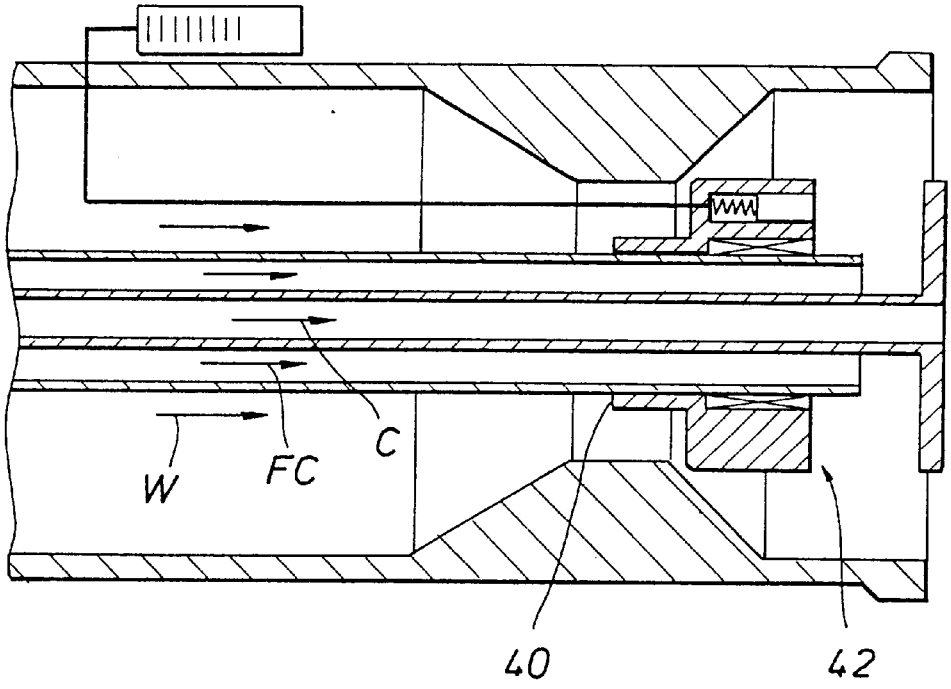
FIG. 4A is included primarily to illustrate one possible location for a flow meter within an embodiment of the present invention.
Figure 4B:
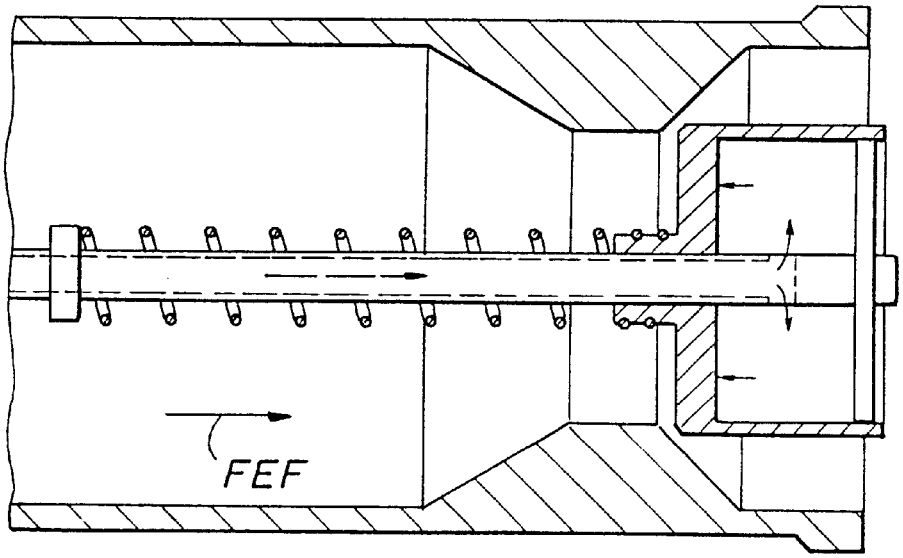
FIG. 4B illustrates an alternate embodiment of the invention wherein a baffle chamber slides over a fixed stem and a fixed piston and a spring located on a fixed stem, the piston being substituted for a relief valve and other embodiments and the spring alternately biasing the piston either out or in depending upon design.

FIG. 4A illustrates one possible location of a flow meter within an embodiment of the present invention. In FIG. 4A a self-educting pressure regulating nozzle is indicated where a relief valve has been designed as an annular relief valve encircling the tube that provides educted fluid into the mixing plate area of the nozzle. A flow meter is illustrated having an attachment to a visible indicator on the outside of the nozzle. The flow meter itself is indicated as residing within the baffle. Another optional location for a flow meter is simply along the inside wall of the nozzle.

FIG. 4B illustrates an embodiment of the invention that was tested but did not yield the accuracy of the relief valve. In FIG. 4B a baffle chamber is shown having a baffle that slides over a fixed stem and a fixed piston. The baffle defines a baffle chamber with backward baffle surfaces. Fluid in the baffle chamber operates backwards against the baffle while the fire extinguishing fluid flowing through the nozzle acts against the baffle forward surfaces for forward pressure against the baffle. In the embodiment of FIG. 4B a spring located around the fixed stem and piston is substituted for the relief valve. The spring could bias the piston either out or in depending upon the spring design.

Figure 4C:
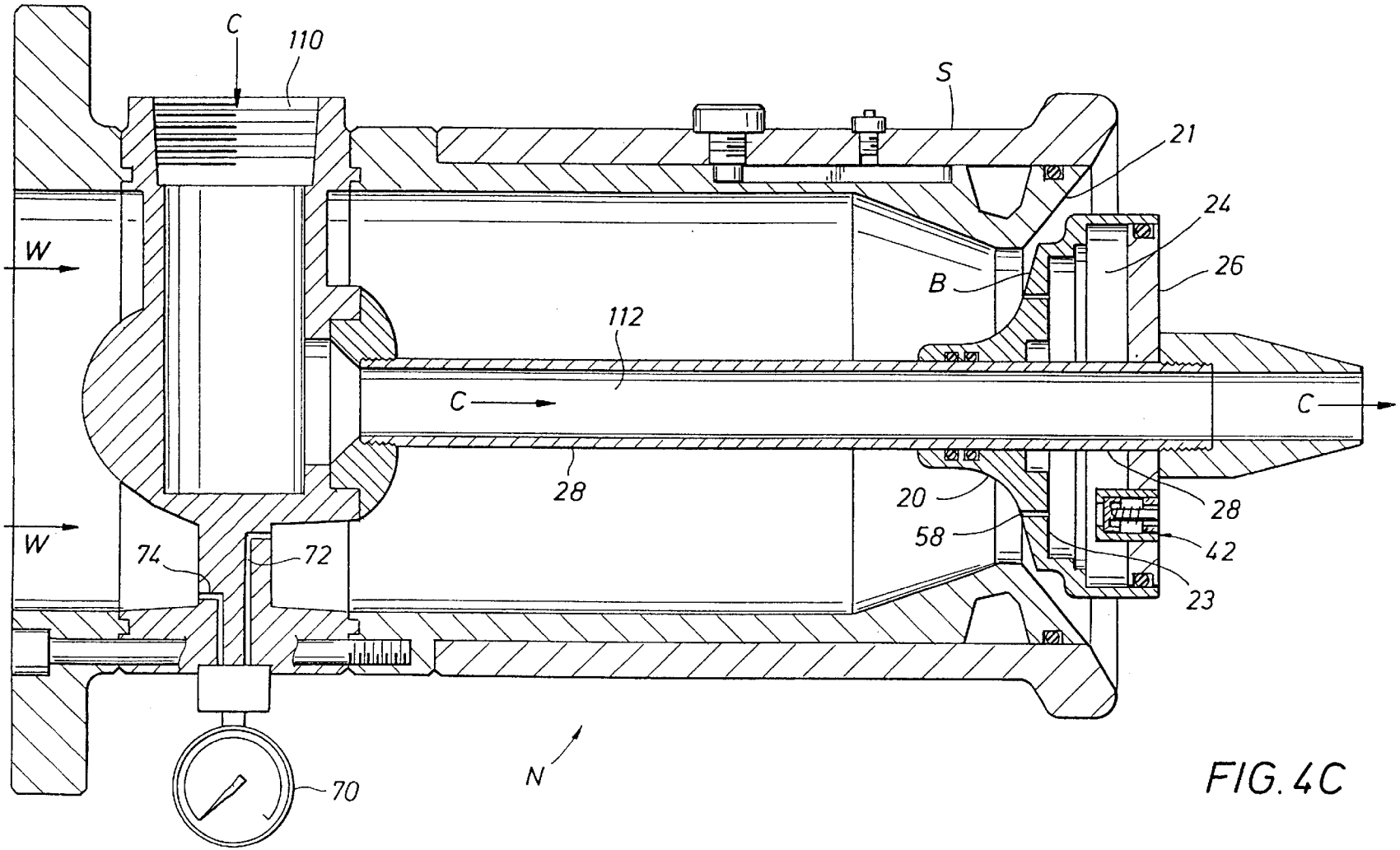
FIG. 4C illustrates in cutaway form an embodiment of an automatic nozzle providing for transporting and discharging a fluid chemical, such as a dry powder, through the center and providing a relief valve triggered on baffle chamber pressure.

FIG. 4C illustrates a self adjusting nozzle designed for also throwing a chemical such as a dry powder. Chemical inlet 110 provides a basis for chemical C to enter the nozzle and be centrally channeled through fixed stem 28 and channel 112 in order to be discharged out the front of the nozzle. Pilot relief assembly 42 is illustrated in the embodiment of FIG. 4C to be similar to pilot relief assembly 42 of FIG. 3A. The embodiment of FIG. 4D is again an automatic pressure adjusting nozzle providing for throwing a chemical such as dry powder that is centrally channeled through the nozzle. The embodiment of 4D differs from the embodiment of 4C in that pilot relief assembly 42 senses pressure on forward surfaces 20 of bafflehead B as opposed to interior surfaces of bafflehead chamber 24.

Figure 4D:
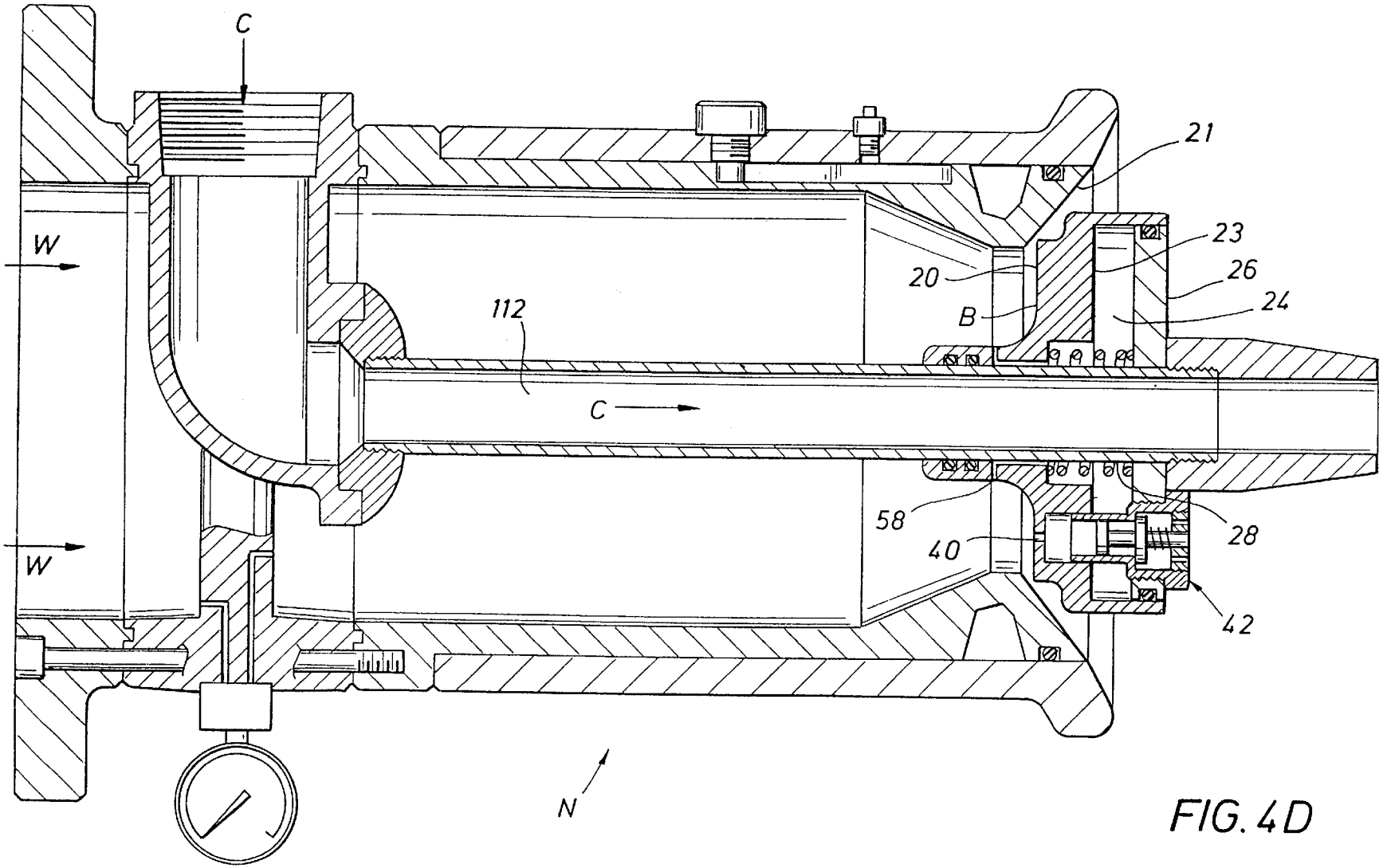
FIG. 4D illustrates in cutaway form an embodiment of an automatic nozzle providing for centrally discharging a fluid chemical with a relief valve triggered one forward baffle surface fluid pressure.
Figure 5A:
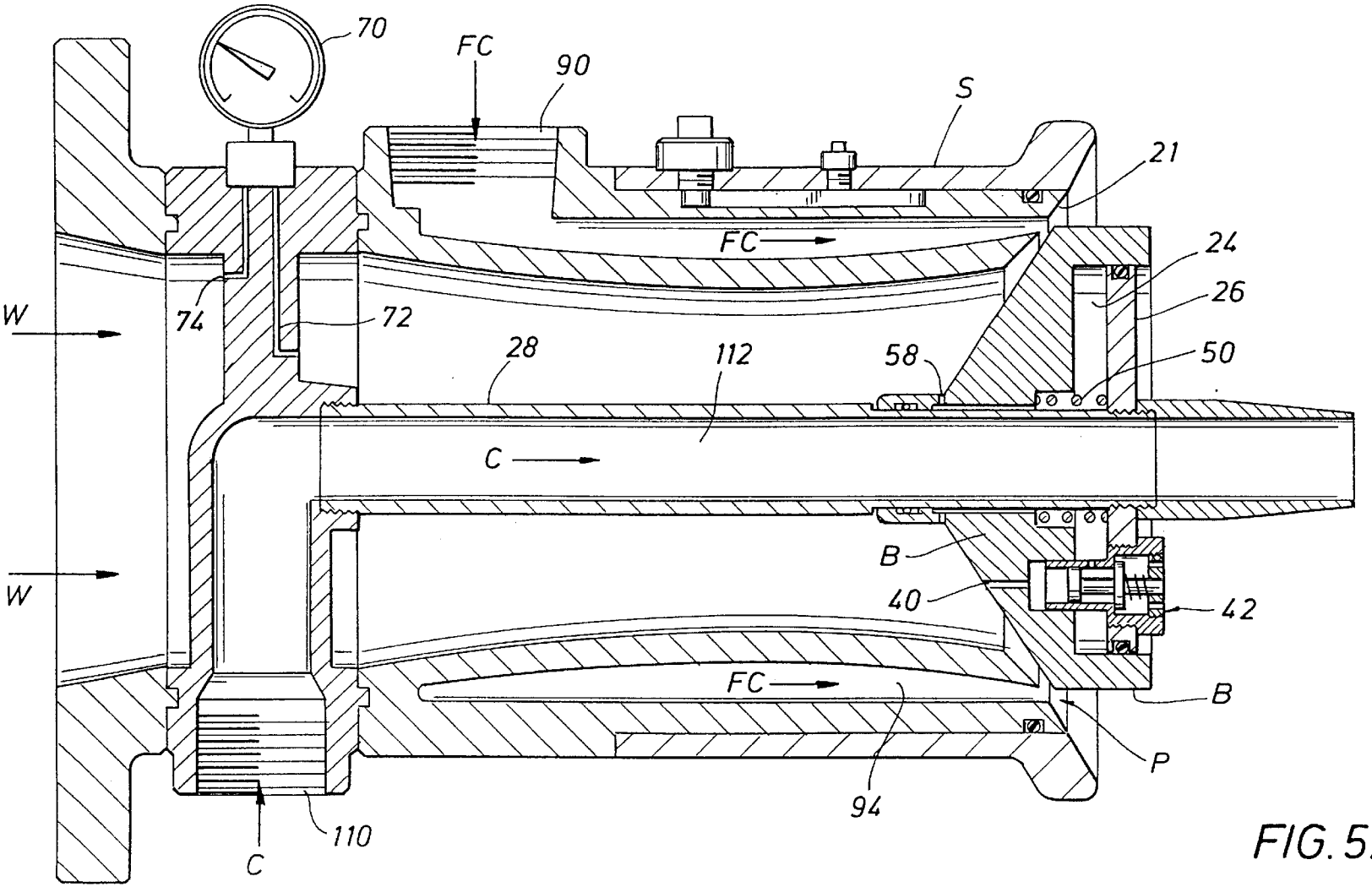
FIG. 5A illustrates in cutaway form an embodiment of an automatic nozzle providing for enhanced educting and channeling foam concentrate peripherally and for discharging a fluid chemical centrally.

The embodiment of FIG. 5A combines an automatic nozzle that centrally channels and throws dry chemical, such as the embodiment of FIG. 4D, with peripheral channeling for foam concentrate such as the embodiment of 3C. Further the eduction for the foam concentrate is enhanced as in the embodiment of FIG. 3C.

Figure 5B:
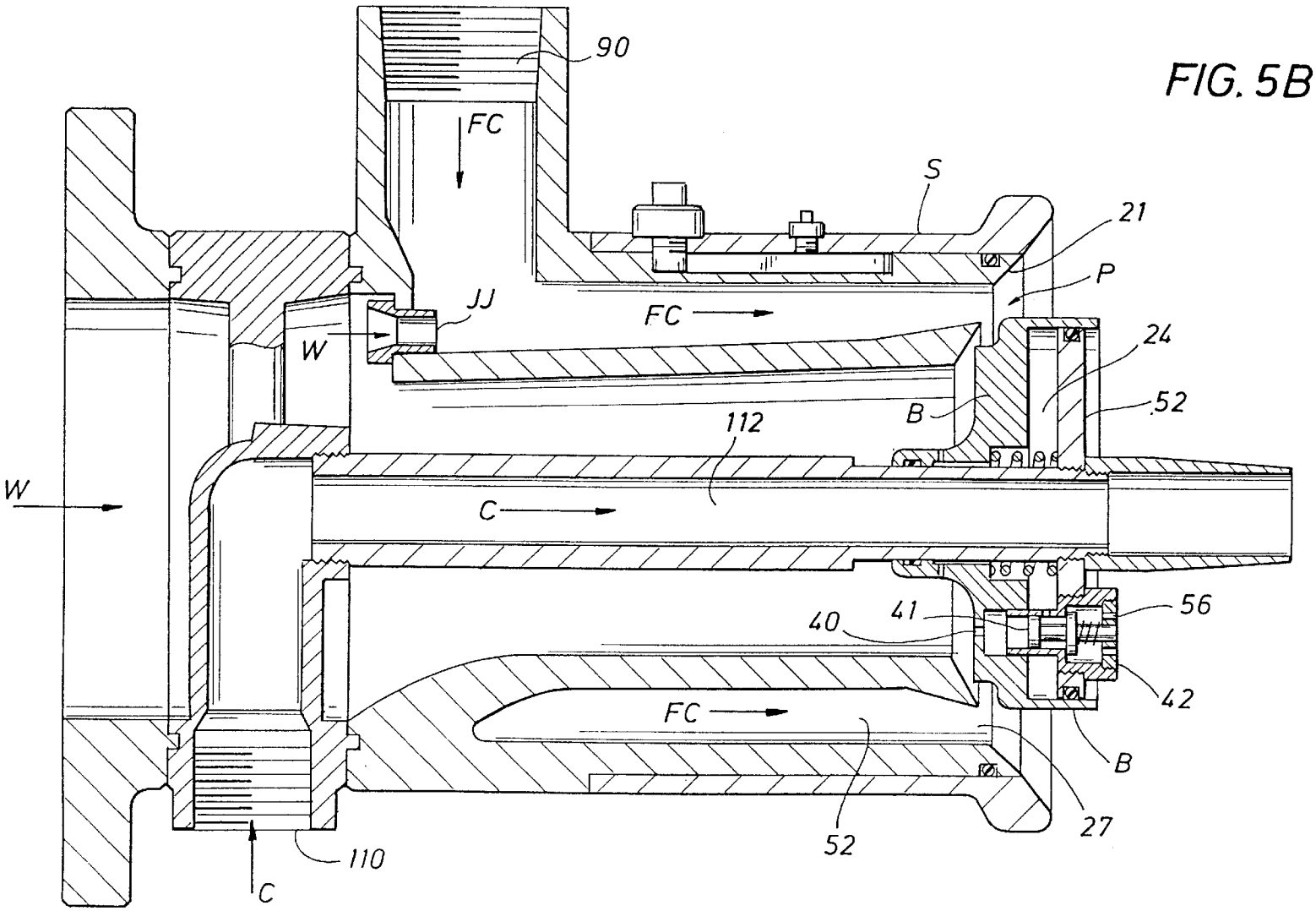
FIG. 5B illustrates in cutaway form an embodiment of an automatic nozzle providing for educting foam concentrate peripherally and discharging a fluid chemical centrally, the embodiment of 5B also including a jet for assisting the educting of the foam concentrate.
Figure 5C:
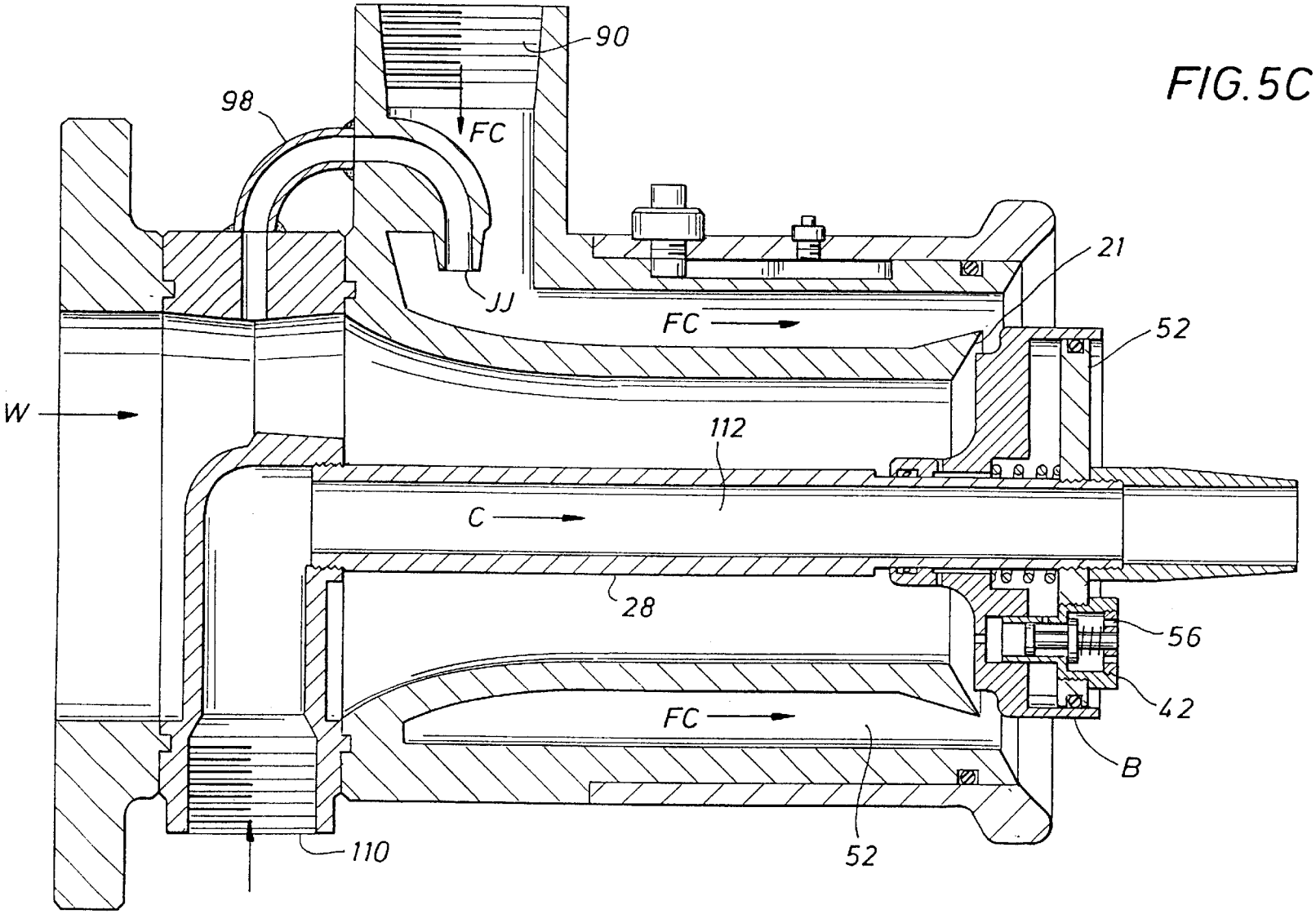
FIG. 5C illustrates an embodiment of an automatic nozzle providing educting foam concentrate peripherally and discharging fluid chemicals centrally, and having a further type of jet eductor for the foam.

The embodiment of FIG. 5B is similar to the embodiment of FIG. 5A except a foam jet JJ is provided to enhance the eduction of foam concentrate FC into peripheral channels 52 of nozzle N, and the enhanced eduction discharge design of FIG. 3A is not utilized. The embodiment of FIG. 5C provides an alternate version for the embodiment of FIG. 5B wherein foam jet JJ utilizes an alternate design.

Figure 6:
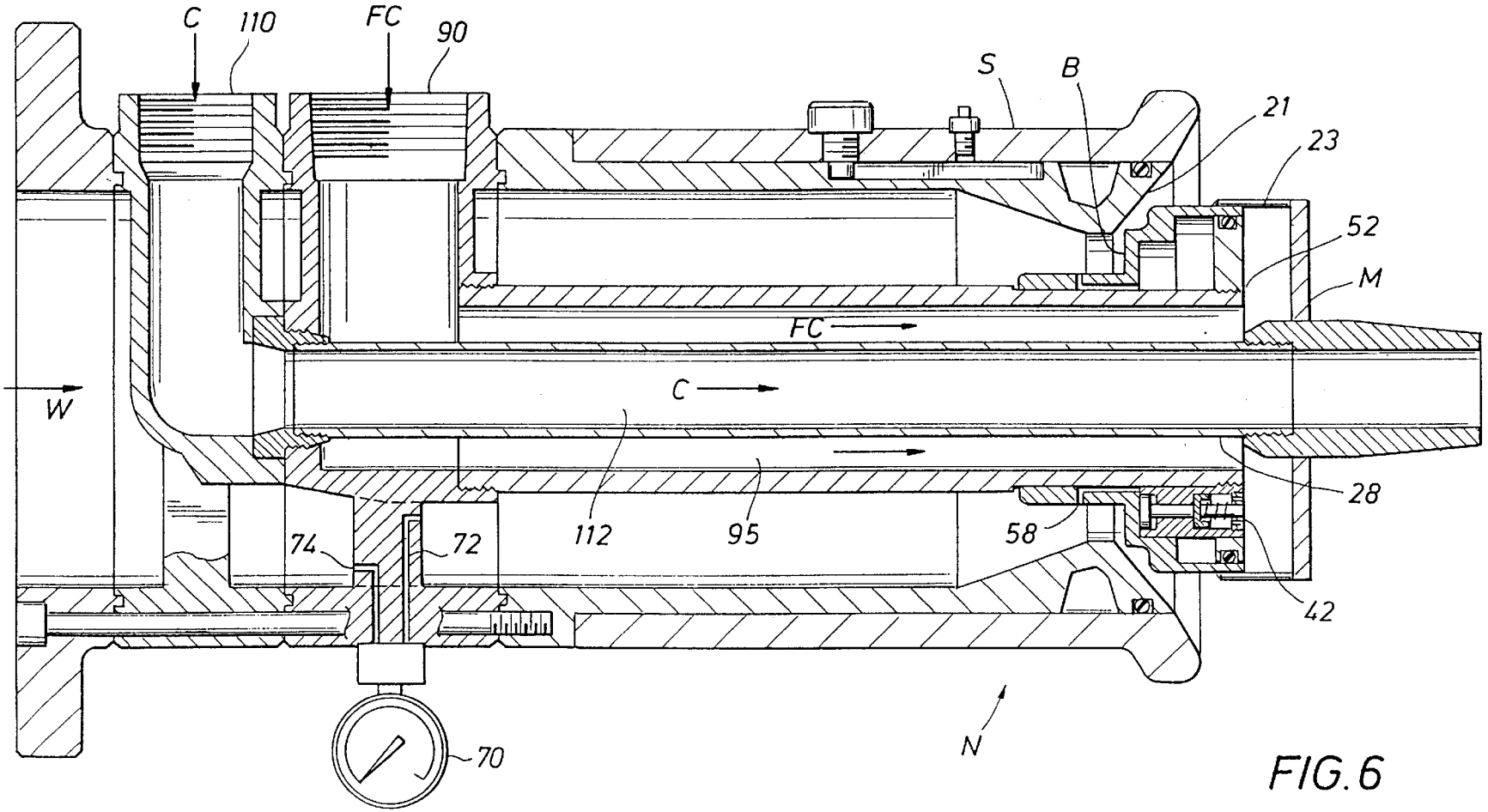
FIG. 6 illustrates in cutaway an automatic nozzle wherein foam concentrate and fluid chemical are both channeled through the nozzle centrally.

The embodiment of FIG. 6 centrally channels both foam concentrate and dry chemical while providing a self adjusting bafflehead.

Figure 7:
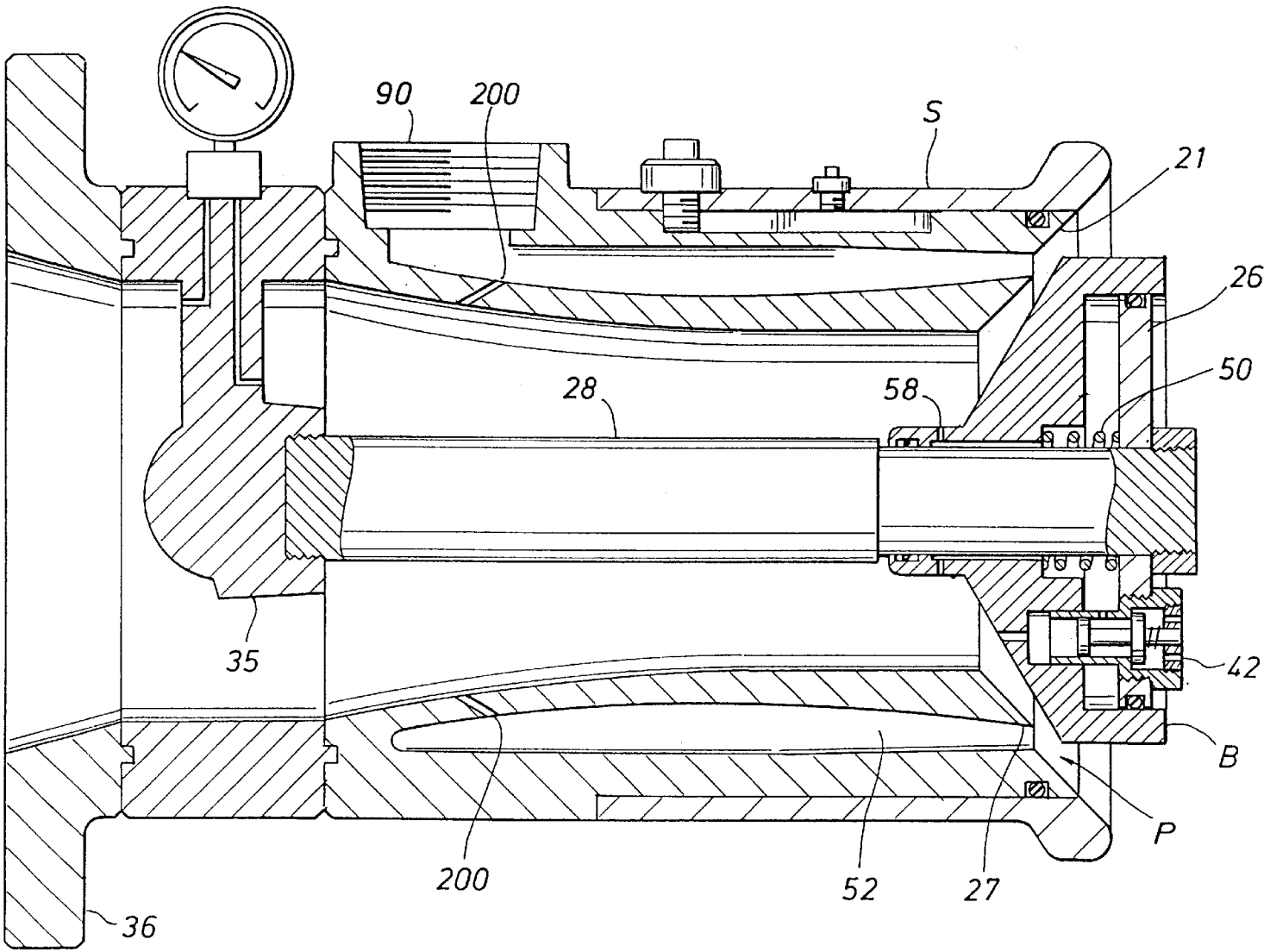
FIG. 7 illustrates an embodiment of an automatic nozzle providing for educting foam with enhanced peripheral discharge.

The embodiment of FIG. 7 is analogous to the embodiment of FIG. 3C with the difference that foam jets 200 provide for further enhanced eduction of foam concentrate FC through foam inlet 90 and out foam outlets 27.

Figure 8:
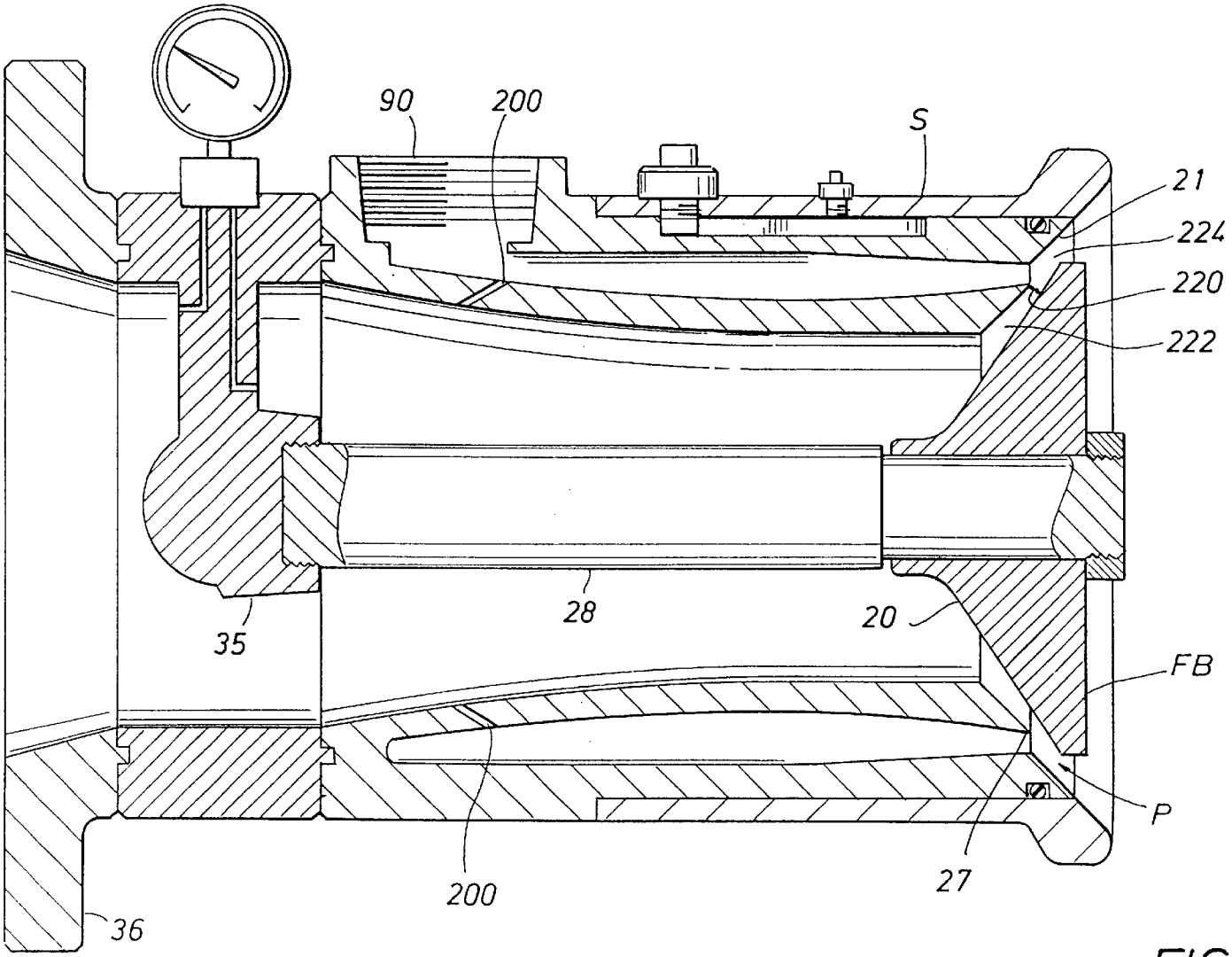
FIG. 8 illustrates a nozzle similar to the embodiment of FIG. 7, but without the automatic feature.
Figure 9:
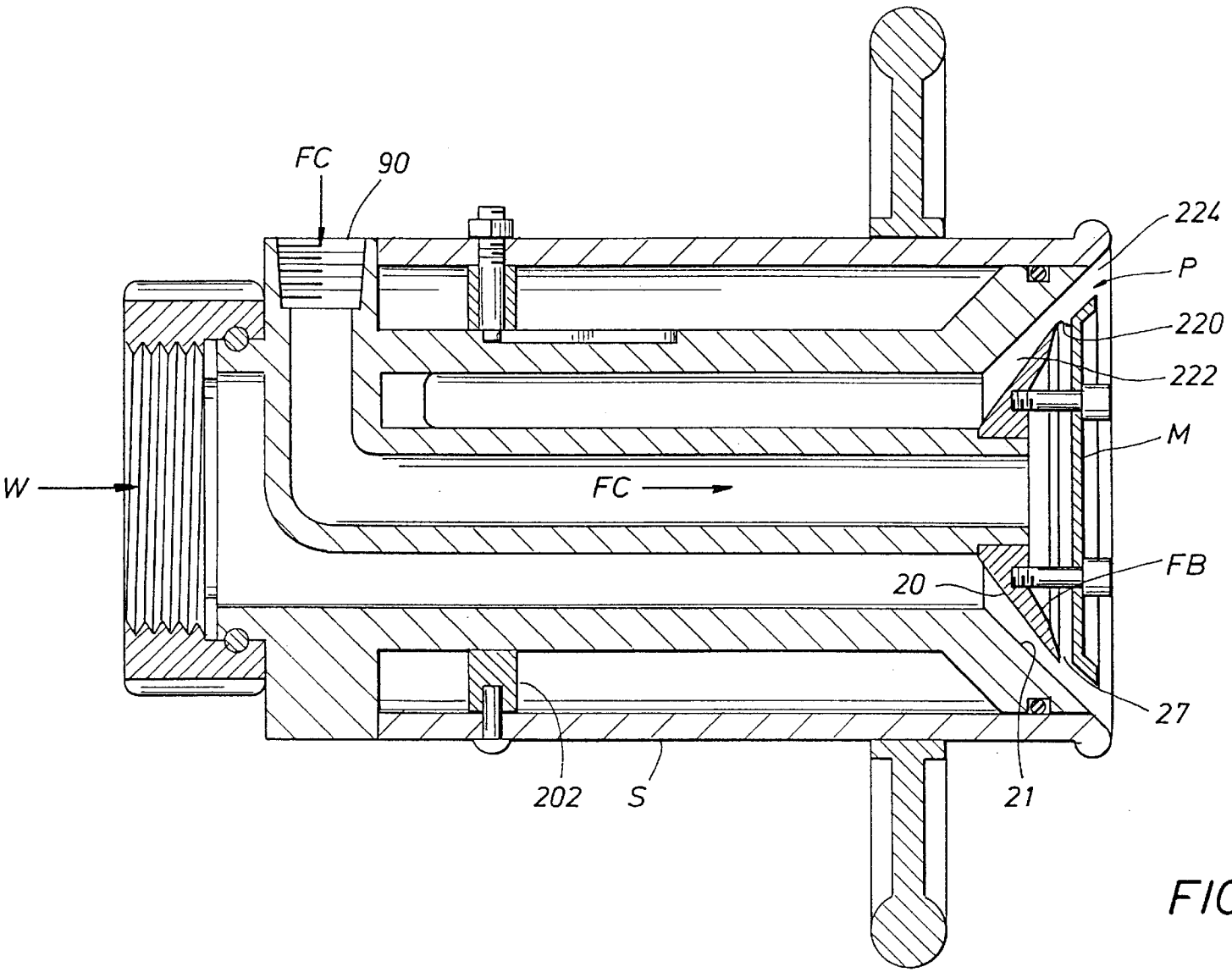
FIG. 9 illustrates an enhanced educting discharge feature wherein the foam concentrate is transported centrally.

FIGS. 8 and 9 illustrate nozzles that are not self adjusting. The nozzles of FIG. 8 and FIG. 9 have a fixed bafflehead FB. FIG. 8 illustrates the value of enhanced educting features even in a nonpressure regulating fixed bafflehead nozzle. Foam jet inlet ports 200 are illustrated jetting small portions of water flowing through the nozzle into annular chamber foam paths 52. Surfaces 21 and 20 are shown shaping a relatively smooth annular stream with diminishing cross section for the water just prior to passing over foam outlet 27 at the discharge end or port P of nozzle N. FIG. 9 illustrates the enhanced self educting feature for centrally channeled foam concentrate FC. In FIG. 9 surfaces 21 and 20 again shape a relatively smooth annular stream of water just adjacent passing over foam port 27, the relatively smooth annular stream of water having a slightly diminishing cross section area down to a minimum area just prior to passing over foam concentrate port 27.

In operation, as discussed above, the self-adjusting automatic feature of the present invention depends upon an adjustable baffle that adjusts, at least in significant part, in response to primary fire fighting fluid pressure presented both to a forward and a reverse side of a baffle surface. In such a manner the baffle operates at least in part as a two-way piston seeking a balanced pressure position. The nozzle fluid provides a fluid pressure to act against both sides of the baffle. The pressure acting in the reverse direction will be at least a function of the forward pressure. Preferably the reverse pressure surface of the baffle will be larger than the forward pressure surface of the baffle. It is recognized that the forward pressure surface of the baffle may in fact change and be a function of pressure and fluid flow through the nozzle and baffle design and nozzle size. Although it would be possible to design a baffle having a balanced position where the targeted pressure forward times the forward pressure surface equals the reverse pressure times the reverse pressure surface, such a balancing technique is difficult to effect'in practice. Hence, preferred embodiments of the present invention utilize at least one relief valve. Preferred embodiments further utilize a relief valve to relieve pressure in the reverse direction. In preferred embodiments the area of the reverse pressure surface is greater than the area of the forward pressure surface. Thus, in preferred embodiments when the relief valve is closed, in general, the reverse pressure times the area of the reverse pressure surface will be greater than the forward pressure times the area of the forward baffle surface. This will dictate that for significant values of forward pressure the nozzle is biased closed. As the baffle closes, the pressure forward at the bafflehead will tend toward its maximum deliverable pressure in the nozzle. At some point near the forward target pressure, one or more relief valves begin to open relieving pressure on the reverse side of the baffle and allowing the bafflehead to balance onto open and adjust outward. Preferably the relief valve builds in a degree of adjustability such that the relief valve can select a partially opened position and settle upon such position without undue hunting and wherein the target pressure times the forward surface at the target pressure equals the reverse pressure times the reverse pressure surface area taking into account the degree of openness of the relief valve system.

While there are shown and described present preferred embodiments of the invention, it is to be distinctly understood that the invention is not limited thereto, but may otherwise variously embodied and practiced within the scope of the following claims.

The foregoing disclosure and description of the invention are illustrative and explanatory thereof, and various changes in the size, shape, and materials, as well as in the details of the illustrated system may be made without departing from the spirit of the invention. The invention is claimed using terminology that depends upon a historic presumptive presentation that recitation of a single element covers one or more, and recitation of two elements covers two or more, and the like.

What is claimed is:

1. A self-metering self-educting pressure regulating nozzle for delivering a fire extinguishing stream, comprising;

a baffle adjustably located proximate a nozzle discharge wherein the baffle and the nozzle relatively adjust to vary a nozzle discharge port in response to a primary fire extinguishing fluid pressure;

an eductor attached to the nozzle and structured such that a fire extinguishing fluid provides an eductive force to educt a second fluid into the nozzle and to mix the second fluid with at least a preponderance of the fire extinguishing fluid proximate the nozzle discharge; and an adjustable proportioning valve in fluid communication with the eductor, the valve structured to adjust the amount of the second fluid educted in response to at least one of (a) the adjustment of the baffle; (b) the pressure of the fire extinguishing fluid at the nozzle; and (c) the flow rate of the fire extinguishing fluid at the nozzle.

2. The nozzle of claim 1 wherein the baffle and nozzle relative adjustment is moderated by a pilot valve sensing forward fluid pressure upon a forward baffle surface.

3. The nozzle of claim 1 wherein said second fluid is educted along peripheral portions of a nozzle wall.

4. The nozzle of claim 1 that includes means for supplying an additional fluid chemical to the discharge end of the nozzle and for discharging the chemical encompassed by the fire extinguishing stream.

5. The nozzle of claim 4 wherein the chemical includes dry powder.

6. The nozzle of claim 3 wherein peripheral portions of the nozzle wall define a channel with an inlet for the second fluid and with at least one port proximate the inlet structured to direct a jet of fire extinguishing fluid into the channel.

7. A method for extinguishing fire comprising automatically adjusting a nozzle baffle to discharge a fire extinguishing fluid at approximately a targeted pressure;

educting an additive liquid into the nozzle using an eductive force provided by a primary fire fighting fluid;

mixing the additive liquid with at least a predominant portion of the fire extinguishing fluid proximate a nozzle discharge; and metering the additive liquid into the nozzle using an adjustable proportioning valve in fluid communication with an eductor, the valve structured to adjust the amount of the additive liquid educted in response to at least one of (a) the adjustment of the baffle; (b) the pressure of the fire extinguishing fluid at the nozzle; and (c) the flow rate of the fire extinguishing fluid at the nozzle.

8. A self-metering self-educting pressure regulating nozzle for extinguishing fires, comprising:

a baffle adjustably located proximate a nozzle discharge;

the baffle providing forward and opposing surfaces in communication with pressure from a primary fire extinguishing fluid;

wherein baffle adjustment is affected, at least in part, by pressure upon the forward and opposing baffle surfaces;

at least one relief valve triggered to relieve pressure upon an opposing baffle surface when sensed fire extinguishing fluid pressure exceeds a preselected relief valve pressure;

an eductor attached to the nozzle structured such that a supply of a fluid to the nozzle provides an eductive force to educt a second fluid into the nozzle and to mix said second fluid with at least a preponderance of the eductive fluid proximate the nozzle discharge; and an adjustable proportioning valve in fluid communication with the eductor such that the valve adjusts the amount of the second fluid educted in response to at least one of (a) the adjustment of the baffle; (b) the pressure of the primary fire extinguishing fluid; and (c) the flow rate of the primary fire extinguishing fluid.

9. The nozzle of claim 8 wherein, for at least a significant pressure range for the nozzle, an effective opposing pressure surface area of the baffle exceeds an effective forward pressure surface area of the baffle.

10. The nozzle of claim 9 that includes a spring biased relief valve.

11. The nozzle of claim 10 wherein the relief valve relieves fluid pressure on the opposing baffle surface when the sensed primary fire extinguishing fluid pressure exceeds to a greater extent a preselected relief valve pressure.

12. The nozzle of claim 8 wherein the baffle defines a baffle chamber and wherein the primary fire extinguishing fluid pressure is sensed upon the outside of the baffle chamber.

13. The nozzle of claim 12 wherein the relief valve is located at least substantially within the baffle chamber.

14. The nozzle of claim 8 that includes a flow meter attached to the nozzle for measuring at least one indicator of fluid flow through the nozzle.

15. The nozzle of claim 8 wherein the adjustable proportioning valve includes a variable orifice in fluid communication with the eductor, the orifice varying with an adjustment of the baffle.

16. The nozzle of claim 8 that includes means for supplying a third fluid chemical to the discharge end of the nozzle and for discharging the chemical encompassed by the fire extinguishing fluid.

17. The nozzle of claim 8 wherein the second fluid is educted along peripheral portions of a nozzle wall.

18. The nozzle of claim 17 that includes nozzle assembly wall portions structured to shape liquid flow proximate the assembly discharge into a relatively smooth annular stream having a cross-sectional area that gradually diminishes to a minimum and subsequently expands; and an additive fluid discharge port structured to open onto a portion of the shaped annular steam downstream of and proximate to the minimum.

19. The nozzle of claim 17 wherein peripheral portions of the nozzle wall define a channel with an inlet for the second fluid and with at least one port proximate the inlet structured to direct a jet for fire extinguishing fluid into the channel.

20. The nozzle of claim 8 wherein the eductor is structured to educt the second fluid into a conduit surrounded by the primary fire extinguishing fluid.

21. A self-metering self-educting pressure regulating fire fighting nozzle comprising means for adjusting a baffle to regulate discharge pressure of a fire fighting fluid in response to sensed fluid pressure;

means attached to the nozzle for educting a second fluid into the nozzle and for mixing the second fluid with at least a predominant portion of the fire fighting fluid proximate the nozzle discharge; and means for metering the second fluid into the nozzle in accordance with adjustment of the baffle.

22. The apparatus of claim 21 including means for discharging fluid chemical encompassed by fire extinguishing fluid.

23. A self-metering self-educting pressure regulating fire fighting method comprising adjusting a baffle for regulating discharge pressure of a fire fighting fluid in a self-educting pressure regulating fire-fighting nozzle in response to sensed pressure;

educting a second fluid into the nozzle using means attached to the nozzle for providing an eductive force on the second fluid;

metering the second educted fluid into the nozzle in tandem with baffle adjustment; and mixing the second fluid with at least a predominant portion of the fire fighting fluid proximate the nozzle discharge.

24. The method of claim 23 including discharging fluid chemical encompassed by fire extinguishing fluid.

25. A method for extinguishing fire comprising:

providing an adjustable baffle located proximate a nozzle discharge;

adjusting the location of the baffle with respect to the nozzle discharge, at least in part, by balancing fluid pressure upon forward and opposing baffle surfaces;

sensing a first fluid pressure proximate a baffle forward pressure surface;

triggering at least one relief valve to relieve fluid pressure upon opposing baffle pressure surface when sensed fluid pressure exceeds a preselected relief valve pressure;

self educting a second fluid into the nozzle using means attached to the nozzle for providing an eductive force on the second fluid; and metering the second fluid into the nozzle in accordance with adjustment of the baffle.

* * * * *